US011219985B2

(12) United States Patent
Milligan et al.

(10) Patent No.: US 11,219,985 B2
(45) Date of Patent: Jan. 11, 2022

(54) WRENCH FOR MAXIMIZING TORQUE

(71) Applicant: Wright Tool Company, Barberton, OH (US)

(72) Inventors: Kenneth R. Milligan, Uniontown, OH (US); Terry G. Taylor, Copley, OH (US)

(73) Assignee: WrightTool Company, Barberton, OH (US)

( * ) Notice: Subject to any disclaimer, the term of this patent is extended or adjusted under 35 U.S.C. 154(b) by 380 days.

(21) Appl. No.: 16/180,249

(22) Filed: Nov. 5, 2018

(65) Prior Publication Data

US 2019/0134787 A1 May 9, 2019

Related U.S. Application Data

(60) Provisional application No. 62/581,088, filed on Nov. 3, 2017.

(51) Int. Cl.
*B25B 13/08* (2006.01)

(52) U.S. Cl.
CPC ..... *B25B 13/08* (2013.01)

(58) Field of Classification Search
CPC ..... B25B 13/08; B25B 13/04; B25B 13/48; B25B 13/56; B25B 13/065
USPC ..... 81/119, 186, 58.2
See application file for complete search history.

(56) References Cited

U.S. PATENT DOCUMENTS 3,003,379 A 10/1961 Pribitzer
3,745,859 A 7/1973 Evans et al.
3,757,614 A 9/1973 Evans et al.
3,850,057 A 11/1974 Evans
3,868,873 A 3/1975 Evans
3,931,749 A 1/1976 Evans
4,688,454 A 8/1987 Scull
5,074,171 A 12/1991 Annis et al.
5,117,714 A 6/1992 Pagac et al.
5,533,428 A 7/1996 Pradelski
5,551,322 A 9/1996 Mikic et al.
5,953,968 A 9/1999 Macor
5,996,449 A 12/1999 Hsieh
6,089,131 A 7/2000 Taimiot
6,145,414 A * 11/2000 Hsieh ..... B25B 13/08 81/119
6,276,240 B1 8/2001 Blacklock
(Continued)

FOREIGN PATENT DOCUMENTS

CN 2179808 Y 10/1994
CN 2561556 Y 7/2003
(Continued)

*Primary Examiner* — David B. Thomas

(74) *Attorney, Agent, or Firm* — Walter Haverfield LLP; Sean F. Mellino

(57) ABSTRACT

An open-end hexagonal wrench having opposing jaws extending forwardly from a handle, the respective jaws having forwardly disposed, opposing planar faces, the forwardly disposed planar faces respectively merging with outwardly curved diverging surfaces with protrusions for penetrating the side of a hexagonal fastener being turned without engaging a corner of the fastener. The rearward ends of the outwardly curved diverging surfaces respectively merging with rear, concave arcuate corners which in turn merge with gentle curves into a concave throat.

22 Claims, 18 Drawing Sheets

(56) References Cited

U.S. PATENT DOCUMENTS

| | | | | |
|---|---|---|---|---|
| 6,443,038 | B2 | 9/2002 | Hsieh | |
| 6,907,805 | B2 * | 6/2005 | Wright et al. | B25B 13/08 81/119 |
| 7,340,982 | B2 | 3/2008 | Wright et al. | |
| 7,788,994 | B2 | 9/2010 | Wright et al. | |
| 8,359,952 | B2 * | 1/2013 | Hsieh | B25B 13/08 81/119 |
| 8,667,873 | B2 | 3/2014 | Hsieh | |
| 8,695,460 | B2 | 4/2014 | Liau | |
| 8,973,471 | B2 * | 3/2015 | Hsieh | B25B 13/04 81/119 |
| 9,452,511 | B2 | 9/2016 | Nguyen | |
| 2011/0239831 | A1 * | 10/2011 | Cole | B25B 23/0071 81/125 |
| 2012/0272794 | A1 | 11/2012 | Huang | |
| 2012/0297936 | A1 | 11/2012 | Chen | |
| 2013/0192428 | A1 | 8/2013 | Chen | |
| 2013/0340575 | A1 * | 12/2013 | Hsieh | B25B 13/08 81/119 |

FOREIGN PATENT DOCUMENTS

| | | | |
|---|---|---|---|
| EP | 0580177 | A1 | 1/1994 |
| EP | 0921912 | A1 | 6/1999 |
| EP | 2517831 | A1 | 10/2012 |
| FR | 2807356 | A1 | 10/2001 |
| GB | 289703 | | 5/1928 |
| JP | 2003340733 | A | 12/2003 |

* cited by examiner

290 IN*LB
IMPROVEMENT.
42% MORE TORQUE
WITH SAME FORCE

9/16" WRENCH SHEAR AREA = 0.20*.216*4+.026*.216=.0229 IN^2

The following is a force diagram for a 9/16" size opening wrench:

The following geometric formula determines the value of $R_2$:

$$R_2 = F_n \frac{\frac{c+b+a\cos\theta}{c} - 1}{\frac{d}{c} + 1}$$

$$R_2 = F_n + R_2$$

(PRIOR ART)
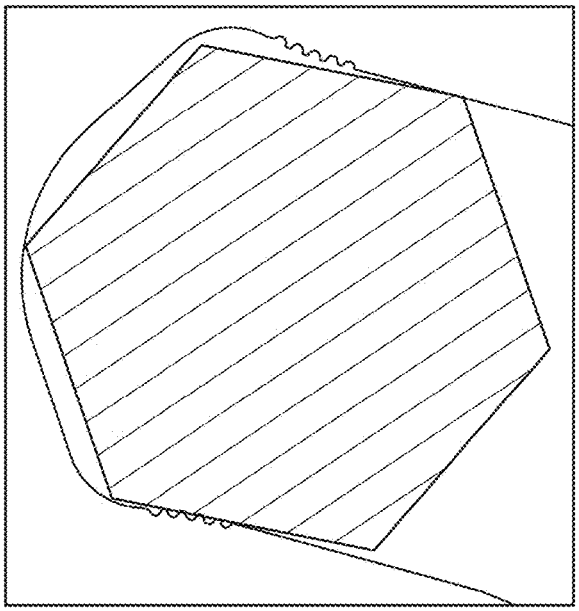
FIG. 12a
(NEW)
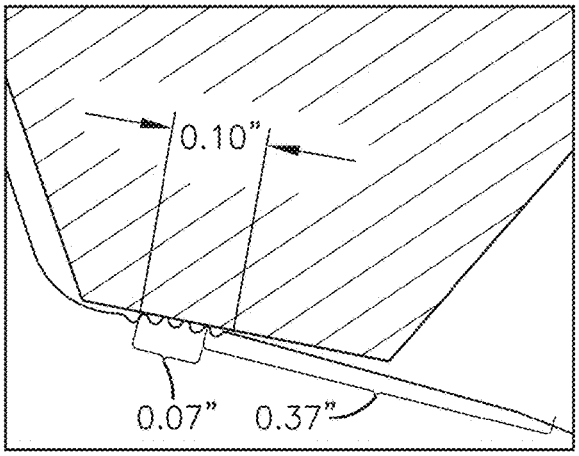
FIG. 12c
(NEW)

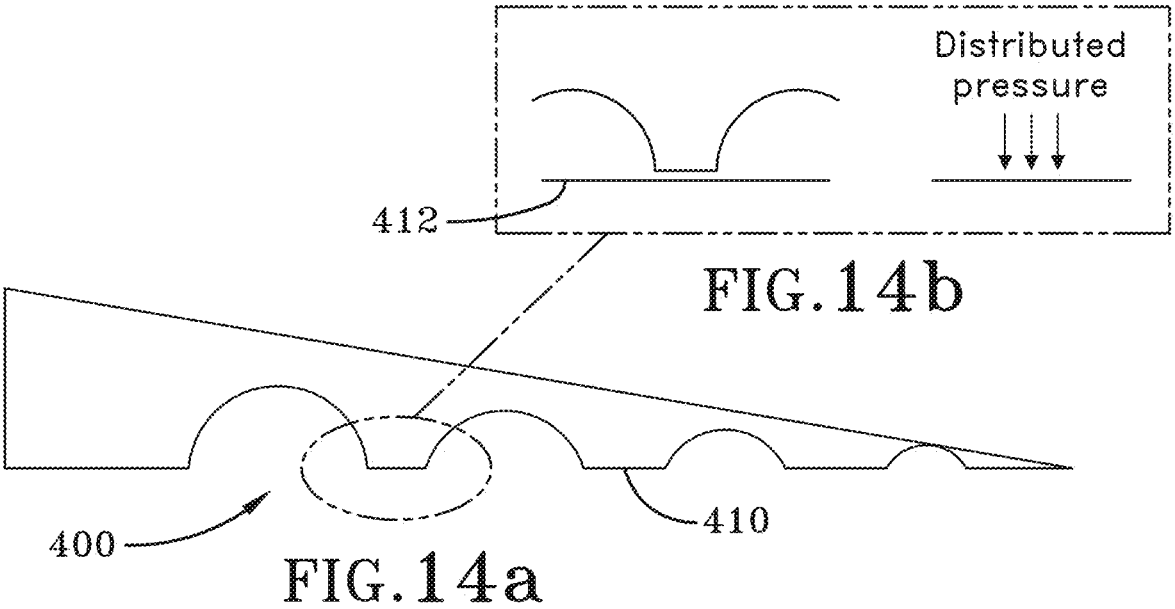
FIG.14b
FIG.14a
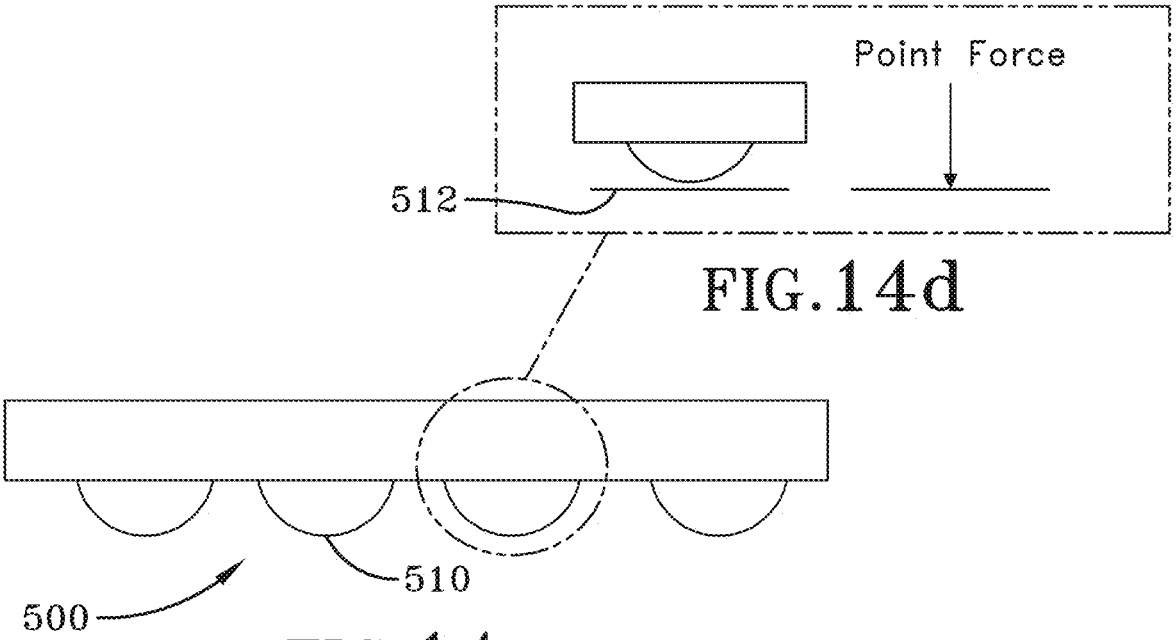
FIG.14d
FIG.14c

WRENCH FOR MAXIMIZING TORQUE

CROSS-REFERENCE TO RELATED APPLICATION

This application claims the benefit of and priority to U.S. Provisional Patent Application No. 62/581,088 filed on Nov. 3, 2017, the entirety of which is incorporated herein by reference.

BACKGROUND OF THE INVENTION

Field of the Invention

This invention relates to an improved tool for turning polygonal fasteners, and in particular to improved open-end wrenches for applying maximum torque to hexagonal fasteners, even in the event that such fasteners have rounded corners.

Description of the Prior Art

Traditional open-end wrenches suffer in that the jaws of such open-end wrenches tend to spread under load. This enables the fastener to rotate within the open-end wrench, which damages the corners of the hexagonal or other polygonal fastener by rounding such corners of the fastener. This rotation moves the fastener toward the outside of the wrench, and this weakens the engagement of the fastener by the wrench (i.e., the engagement between the fastener and the wrench). Moreover, the latter occurrence can damage one or both of the fastener and the wrench. In other words, the fastener becomes unseated in the jaws of the wrench. The occurrence of the fastener becoming unseated is referred to as "walking of the wrench."

A major improvement in open-end wrenches is disclosed in commonly assigned U.S. Pat. No. 6,907,805 (Wright et al. 2005), which open-end wrench is known as the WRIGHT GRIP® wrench. The latter wrench has opposing jaws leading to a throat from its open ends. The forward facing ends of the jaws are planar and parallel, and they diverge in serrated sections as they lead to the throat to reduce contact with the rear corners of the fastener. There are arcuate rear corners which avoid contact with the rear side corners of the fastener and which eliminate stress concentration points. The throat is in part defined by gentle curves or flat surfaces leading to a central arc for providing more metal to the throat to stiffen the jaws.

Other types of protrusions for the present open end wrench can be found in the following patents.

In U.S. Pat. No. 3,745,859 (Evans, et al.), there is a disclosure of a serrated open end wrench having protrusions of a non-symmetrical character capable of extending for surfaces into bearing contact with a hexagonal head nut during the power stroke, but capable of unobstructed reverse or return stroke about the same axis of revolution. In U.S. Pat. No. 3,757,614, an open wrench is disclosed having a recessed wrench surface or configuration of non-symmetrical character having a series of juxtaposed arcuate indentations. The arcuate recesses are formed to extend four surfaces into bearing contact with a hexagonal head nut during the power stroke and retain the capability of unobstructed reverse or return stroke movement about the same axis of revolution.

U.S. Pat. No. 6,443,038 (Hsieh) describes an open-end wrench having a pair of jaws with a nest connecting the two jaws to form a mouth. A first convex surface portion on the first jaw driving surface and a first transverse tooth, a second transverse tooth a second convex surface portion on the second jaw surface is provided. The two convex surface portions of the second jaw are arranged in a predetermined distance from the first convex surface portion of the first jaw driving surface. The distance between the first transverse tooth and the second transverse tooth is a fraction of the distance between the first convex surface portion of the first jaw driving surface and the first transverse tooth.

Referring to French Patent No. 2807356(A1) (Cagny) 2001-10-12, an open end wrench having four protuberances is shown and described. The two protuberances furthest apart, that is the end protuberances, engage the opposite lobe of the head to be driven, and the intermediate front protuberance provides a bearing point on the intermediate front lobe. The fourth protuberance serves as a repositioning guide.

In EP 0921912 (A1) (Simplet, et al.) 1999-06-16, an open end wrench has a jaw for screwing or unscrewing a nut. The fork or jaw has two jaws or branches for screwing in or unscrewing. The groove of the fork provides supporting zones for the proper positioning of the nut.

Referring next to U.S. Pat. No. 6,443,038 (Hsieh), an open-end wrench is provided. A first convex surface portion is provided on the first jaw driving surface, and a first transverse tooth, a second transverse tooth and a second convex surface is provided on the second jaw driving surface. This relates to the grasping and turning of new-type bolts and nuts as well as worn-out bolts and nuts.

U.S. Pat. No. 3,868,873 (Evans) discloses an open-end wrench having opposed, spaced-apart jaws, one of the jaws a torqueing jaw and the other being a backup jaw having a planar working surface. The torqueing jaw has a braking surface and parallel to the backup jaw, the torqueing jaw having an arcuate surface adjacent the braking surface and the torqueing jaw having a ratcheting surface adjacent the arcuate surface.

In U.S. Pat. No. 3,931,749 (Evans), there is provided a ratcheting wrench for a hexagonal fastener. The wrench has a body portion and opposing jaws. The first jaw has an inner peripheral surface facing the member receiving area having four contiguous torqueing surfaces configured to receive a hexagonal member. The torqueing surfaces are at an angle of 120°, and the second jaw has an inner peripheral surface facing the member receiving area having four contiguous torqueing surfaces configured to receive a hexagonal member, each of which being at an angle of 120° relative to any torqueing surface.

In Great Britain Patent No. 289703 (Witter), an open end wrench has a number of 90 or 120 notches for square or hexagonal nuts to give them a series of small turns when in a confined place.

Referring to U.S. Pat. No. 6,276,240 (Blacklock), an open end wrench with two heads can accept fasteners of different nominal sizes. Each head has a first jaw bearing, a convex interior surface facing the interior surface of a second jaw. The second jaw has plural pair of intersecting facets. In one embodiment, the included angle formed between the intersecting facets is greater than 90° and less than 120°, and in another embodiment, the included angle is greater than 70° and less than 90°.

BRIEF SUMMARY OF THE INVENTION

It is an object of the invention to ease the turning of a hexagonal or other polygonal heads of fasteners.

Another object of the present invention is to provide an improved open-end wrench for applying the maximum torque to a fastener, where the latter can be a nut, to facilitate the turning of the nut for either installing the nut on a bolt or removing the nut from the bolt, for removing a bolt having a polygonal head, such as a hexagonal head, from a threaded hole, or the like.

It is still a further object of the present invention to provide an improved open-end wrench for applying the maximum torque to a hexagonal or other polygonal fastener being turned without rounding any corner of the fastener.

A yet further object of the invention is the provision of an open-end wrench for applying maximum torque to a hexagonal or other polygonal fastener, even when such fastener has one or more rounded corners.

Another object of the invention is the provision of a corresponding set of open-end wrenches which is most effective in turning particular sizes of fasteners, and wherein at least one open-end wrench of the set is for applying maximum torque to a hexagonal or other polygonal fastener even when such fastener has one or more rounded corners.

It is yet another object of the present invention to provide a set of open-end wrenches for gripping particular sizes of polygonal fasteners to provide maximum torque to the fastener for turning the fastener, even in the event that all or some of the corners of the polygonal fasteners have been worn down, and wherein at least one open-end wrench of the set is for applying maximum torque to a hexagonal or other polygonal fastener even when such fastener has one or more rounded corners.

A further object of the present invention is the provision of a set of open-end wrenches of specified sizes for turning a set of fasteners of corresponding sizes for imparting a respective maximum torque to the respective sizes of fasteners, and wherein at least one open-end wrench of the set is for applying maximum torque to a hexagonal or other polygonal fastener even when such fastener has one or more rounded corners.

An additional object of the present invention is to provide a set of open-end wrenches of varying sizes for turning hexagonal fasteners of like corresponding sizes while applying maximum torque to the respective sizes of hexagonal fasteners, and wherein at least one open-end wrench of the set is for applying maximum torque to a hexagonal or other polygonal fastener even when such fastener has one or more rounded corners.

Another object of the present invention is to provide a set of open-end wrenches of various sizes for turning polygonal fasteners of the corresponding sizes for imparting maximum torque on the respective fasteners to affect the turning of the respective fasteners, even if the respective fasteners have rounded corners.

It is also an object to find and provide appropriate protrusions to be included with an open-end wrench to enhance the turning ability without damaging, or at least minimizing the likelihood of damaging, the open-end wrench and/or the corresponding fastener being turned by the open-end wrench.

These and other objects will be apparent to those skilled in the art from the description to follow and from the appended claims.

Open-end wrenches having serrations or protrusions on the opposing working surfaces of the jaws which face each other are known by those skilled in the art as being fairly effective in improving the turning ability of open end wrenches. However, as noted above, existing open-end wrenches having such protrusions have known shortcomings. For example, existing open-end wrenches, with protrusions round the corners of fasteners, are often-times unable to turn firmly-held fasteners, are often incapable of turning fasteners with rounded corners, and sometimes result in failure of the wrench and/or of the corresponding fastener.

Careful analyses of perhaps the best known open-end wrenches, such as shown and described in U.S. Pat. No. 6,907,805 (WRIGHT GRIP®) (which is incorporated by reference herein in its entirety), have established that only two protrusions penetrate the fastener which the open-end wrench was attempting to turn. Furthermore, a third protrusion may engage a corner of the fastener and round the fastener corner. A WRIGHT GRIP® wrench is shown in FIG. 1 for turning a hexagonal fastener F and is discussed in greater detail hereinafter. U.S. Pat. Nos. 7,340,982 and 7,788,994, which also pertain to the aforementioned WRIGHT GRIP® wrench, are also incorporated herein by reference in their entireties.

The present inventors have carefully examined known, specific sizes of open-end wrenches with respect to curvatures of the working surfaces, number of protrusions on the working surfaces, shapes or profiles of the respective protrusions, location of the protrusions, size and shape of the serrations between the protrusions and the pattern of the protrusions, largely based upon the phenomenology of the inventor.

With respect to the sizes of the open-end wrenches to which the invention has been applied, which includes all standard sizes of such wrenches, it has been determined by the inventors what are believed to be the optimum curvature of the working surfaces of the open-end wrenches upon which have been studied and worked, the size and profile of the respective protrusions for each size open-end wrench, and the pattern of the protrusions for each size of open-end wrenches.

BRIEF DESCRIPTION OF THE DRAWINGS

FIGS. 14(*a*)-(*d*) depicts various alternative protrusion patterns in accordance with the present invention.

DETAILED DESCRIPTION OF THE PREFERRED EMBODIMENT

Figure 2:
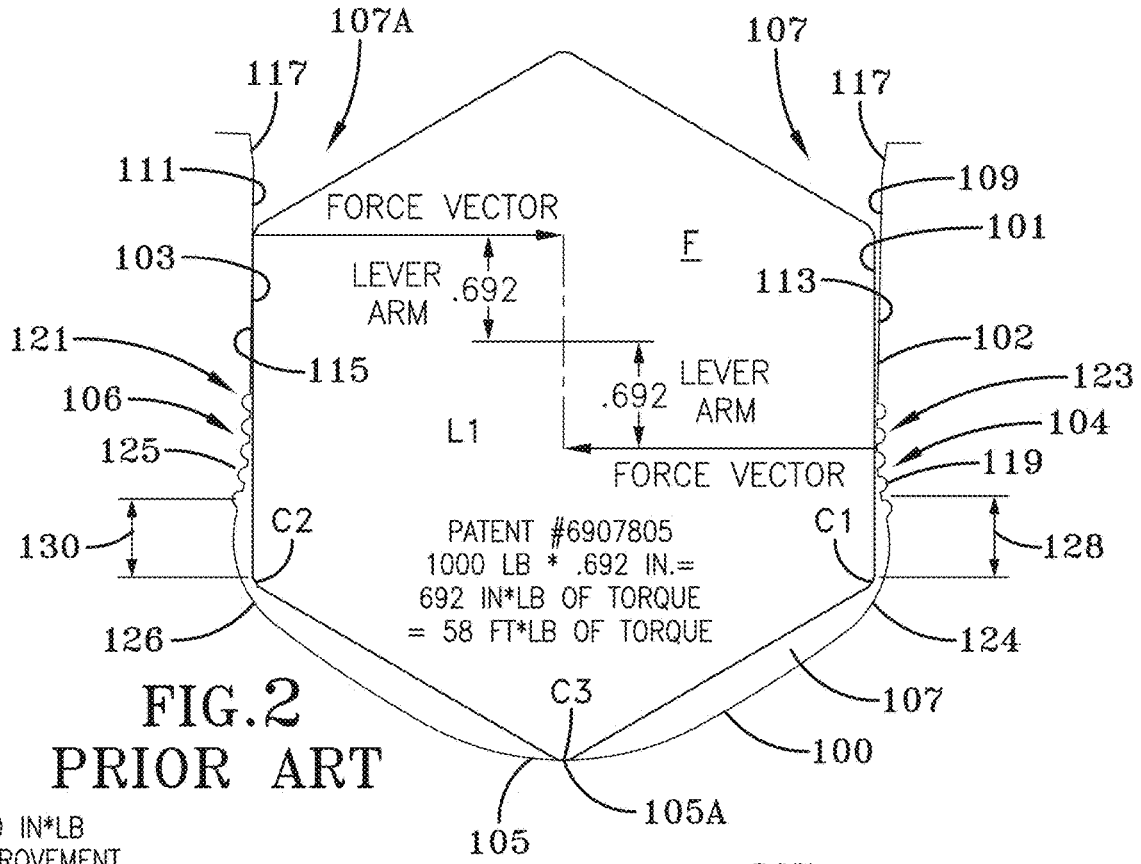
FIG.2 PRIOR ART
FIG. 2 is an enlarged detail view of the wrench and the head of the fastener shown in FIG. 1.

Referring to FIG. 2, an enlarged portion of a hexagonal fastener F is shown engaged by a prior art, partially shown open-end wrench 100 according to U.S. Pat. No. 6,907,805 which is incorporated by reference herein in its entirety. U.S. Pat. Nos. 7,340,982 and 7,788,994, which also pertain to the aforementioned WRIGHT GRIP® wrench, are also incorporated herein by reference in their entireties. Wrench 100 has a head 101 with a pair of fixed jaws 102 and 103 that are connected by a throat 105. Jaws 102 and 103, along with throat 105, define an open-ended fastener-engaging cavity 107. Cavity 107 has an opening 107A at its forward end which can be slipped on fastener F which may be, for example but not limited to, a nut or a bolt head. The term "open-end" wrench and the like should be understood to cover wrenches with fixed jaws, as are shown in the present figures. Each of jaws 102 and 103 has a respective fastener engaging surface 109 and 111. Jaw 102 has a planar section 113 which is parallel with a corresponding planar section 115 of jaw 103. Slightly-outwardly inclined surfaces 117 are angled outwardly at the entrance to cavity 107 on each of jaws 102 and 103. Jaw 102 further has an outwardly diverging curved surface 119 which diverges outwardly from the inner end of planar section 113 towards throat 105, and on which are provided a set of serrations 123. Similarly, jaw 103 has a corresponding outwardly diverging curved surface 121 on which are provided a similar set of serrations 125. The serrations are formed by protrusions at the opposing end of each recess between the protrusions (other than the recesses at either end of outwardly diverging curved surfaces 119 and 121).

When fastener F is engaged by wrench 100, a pair of rounded rear corners C1 and C2 is located in cavity 107. Wrench 100 has a pair of opposing rounded rear corners 124 and 126 which are opposite, respectively, to rear corners C1 and C2 of fastener F. There is preferably a clearance between respective rear corners C1 and C2 and respective rounded rear corners 124 and 126 of wrench 100. When fastener F is fully seated in wrench 100, a rearward corner C3 of fastener F engages throat 105 at an endmost part 105A of throat 105. Throat 105 is rounded and merges with rear corners 124 and 126, respectively, in gentle curves.

Fasteners and fixed jaw wrenches are produced to established standards, which are designed to ensure that the largest fastener that meets specifications for a given nominal size will fit into the smallest wrench of that size. Conversely, the smallest fastener of any nominal size must be gripped and turned by the largest wrench for that size. There will always be some clearance between the fastener and the wrench. The clearance will be minimal with a large fastener and a small wrench and larger with a small fastener and large wrench. The clearance dictates the "free swing" for any given fastener and wrench, i.e., the amount of free rotation of the wrench from the loaded to tightening positions to the opposite or loosening positions. Fastener F has a center of rotation.

Figure 3:
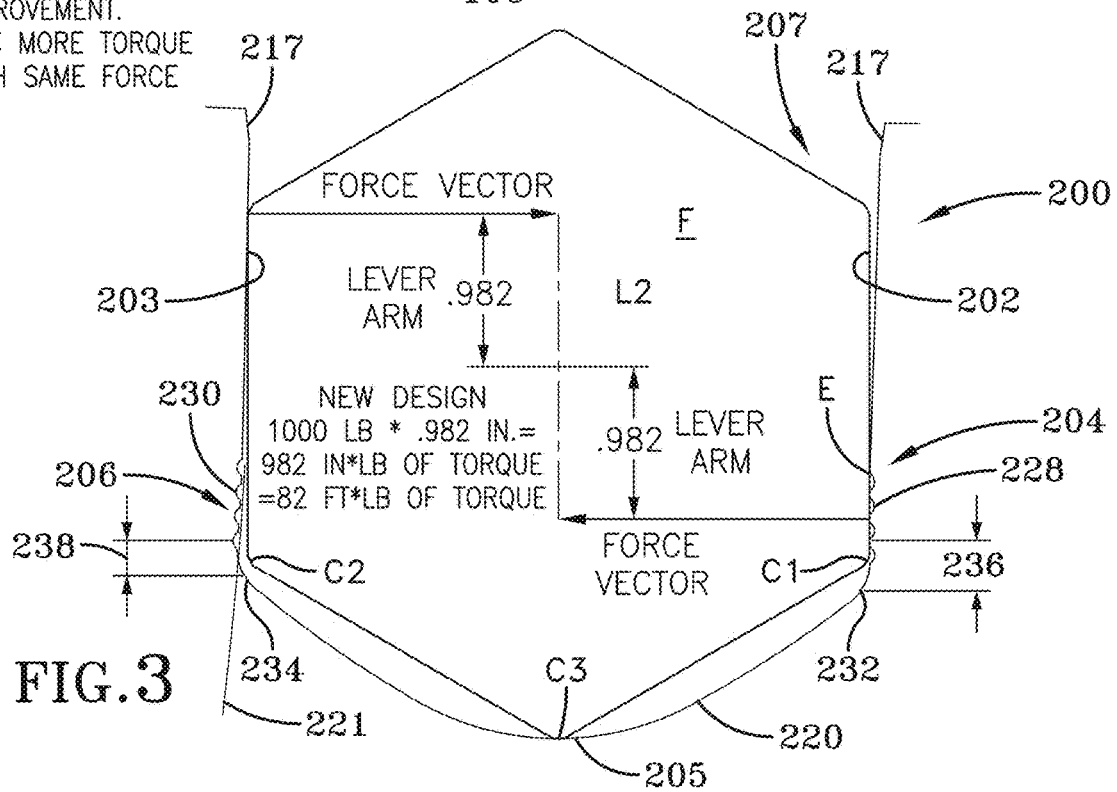
FIG. 3 is an enlarged detail view of a wrench according to an embodiment of the present invention.
Figure 19:
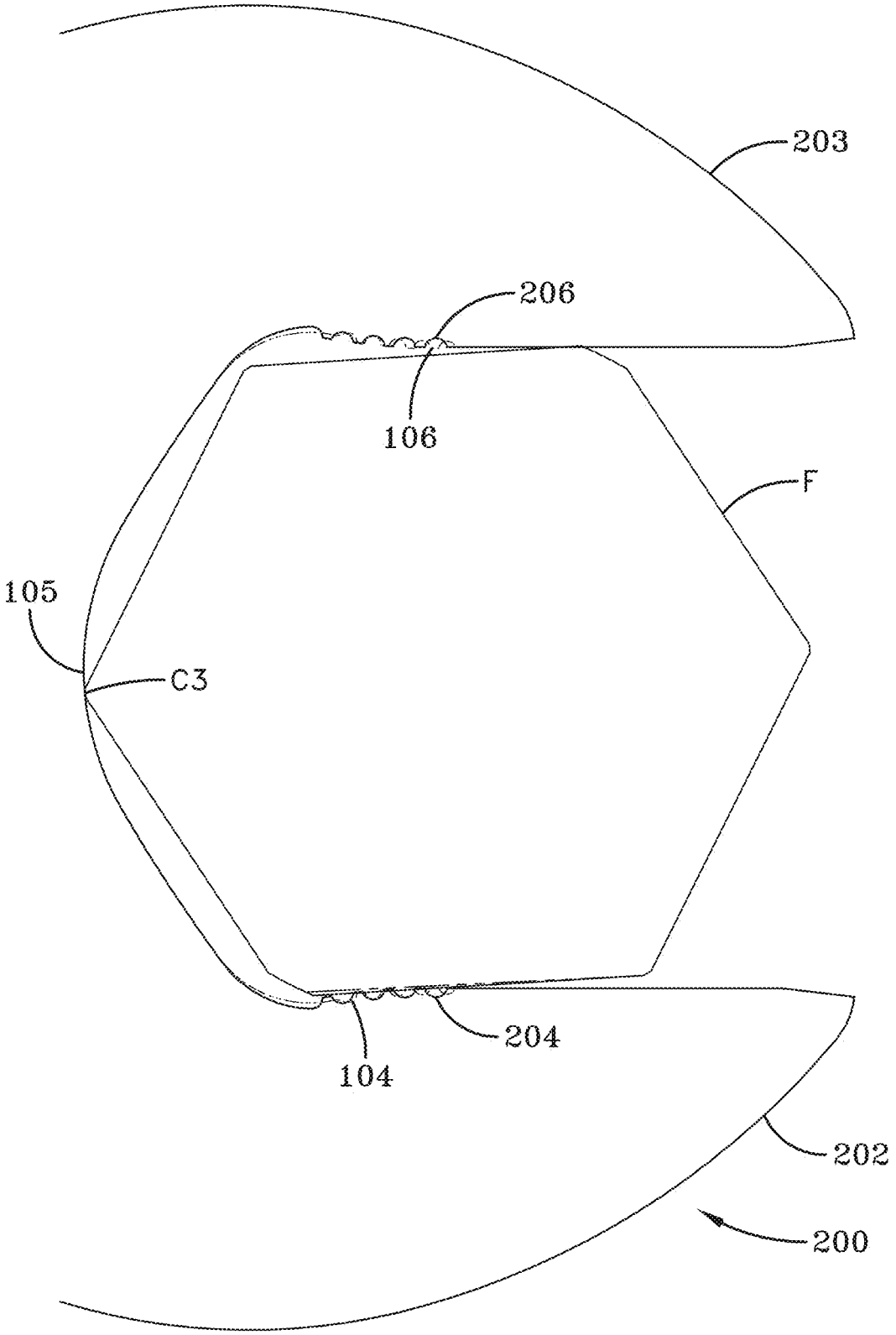
FIG. 19 is another partial plan view of a portion of a wrench according to an embodiment of the present invention superimposed over a portion of a wrench shown in FIG. 1, engaging the head of a hexagonal fastener.

An enlarged representation of a portion of an open-end wrench 200 according to a preferred embodiment of the invention is shown in FIG. 3, having protrusions on one of the working surfaces that would turn to tighten the depicted right hand hexagonal fastener F. See also FIG. 19. Exemplified wrench 200 has a pair of oppositely disposed equally dimensioned, opposite jaws 202, 203. Wrench 200 could be, for example, a 9/16 inch size open-end wrench, but the invention will apply to any size of open-end wrench having protrusions as described below along with other features of the invention, including but not limited to ¼inch, 5/16 inch, ⅜ inch, 7/16 inch, ½ inch, ⅝ inch, 11/16 inch, ¾ inch, 13/16 inch, ⅞ inch, 15/16 inch, 1 inch, 1 1/16 inch, 1⅛ inch, 1¼ inch, 1 3/16 inch, and the like. Fastener F has six corners as was explained previously with respect to FIG. 1. Wrench 200 has a pair of opposite sets of protrusions 204 and 206. Fastener F is a right hand fastener as mentioned, and is tightened by turning it in the clockwise direction. When wrench 200 is tightening fastener F, protrusions 204 are the driving protrusions. This will be explained further hereinafter.

Figure 4:
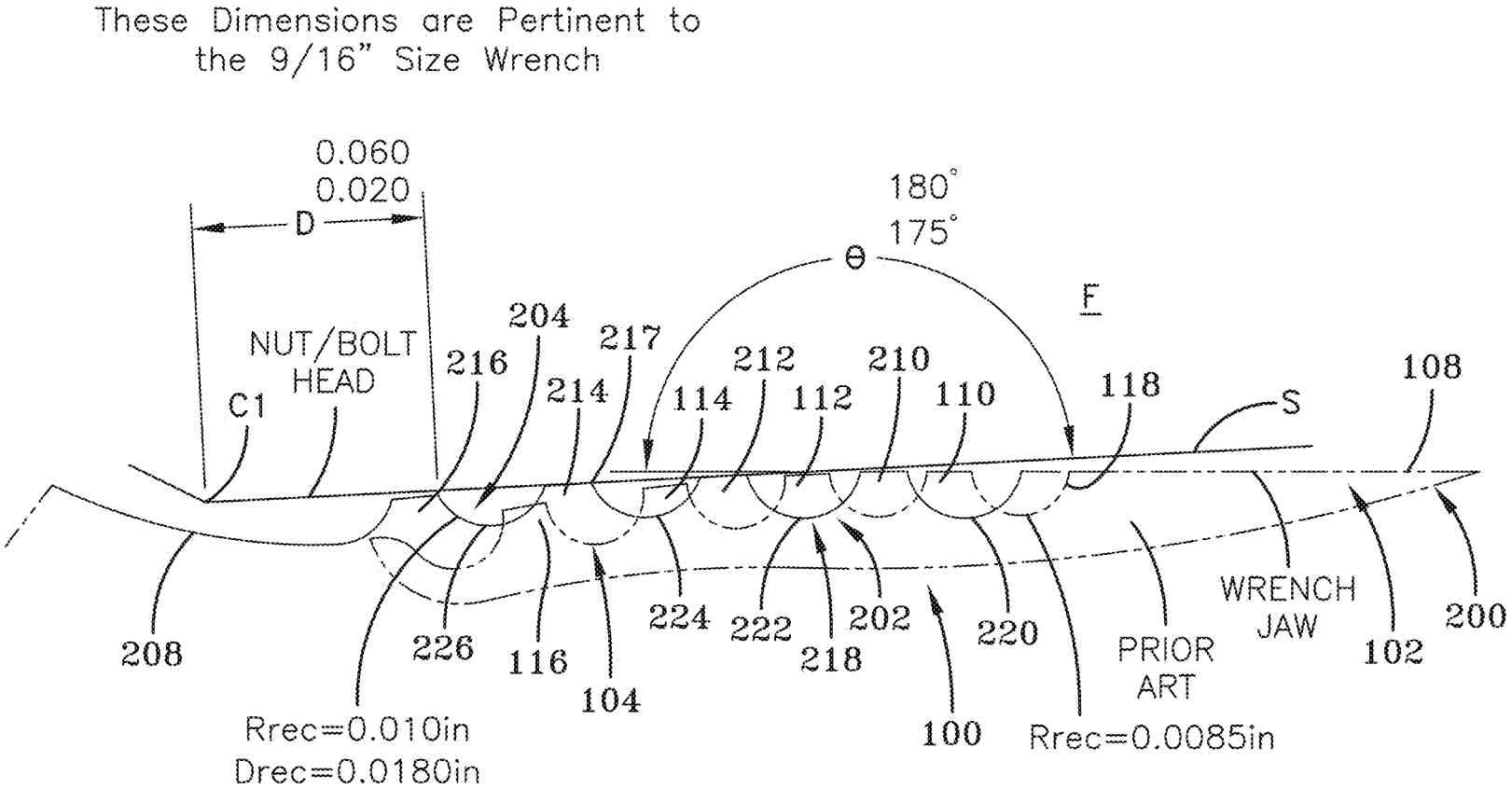
FIG. 4 is an enlarged, detail view of a portion of a wrench according to an embodiment of the present invention superimposed over a portion of the wrench shown in FIG. 1, engaging the head of a hexagonal fastener.

WRIGHT GRIP® is believed to be the finest open end wrench available since it was first introduced. Open end wrenches according to the present invention represent yet another innovation, as is explained with reference to FIG. 4. For the wrenches discussed with respect to FIG. 4, WRIGHT GRIP® wrench 100 is shown as a 9/16 inch size open wrench. However, it should be understood and appreciated that in accordance with the present invention, the innovation is not intended to be limited solely to a 9/16 inch size open wrench but rather to any other particular desired size open wrench. Jaw 102 from WRIGHT GRIP® wrench 100 is partially shown in FIG. 4 in dotted lines 108. Jaw 202 according to the embodiment of the present invention is partially shown also in FIG. 4 in bold, solid lines 208. Both jaws 102 and 202 are in engagement with fastener F. Jaws 102 of WRIGHT GRIP® wrench 100 includes set of protrusions 104 including protrusions 110, 112, 114 and 116, but as shown in FIG. 4, only protrusions 110 and 112 are able to engage the surface of fastener F. However, and very importantly, set of protrusions 204 includes protrusions 210, 212, 214 and 216 which all simultaneously engage a surface S of fastener F while in a resting engagement between fastener F and wrench 200. Moreover, protrusions 110 and 112 which engage fastener F when wrench 100 is turning to tighten fastener F, protrusions 114 and 116 do not engage fastener F, and are all spaced from a surface S of fastener F. However, protrusions 210, 212, 214 and 216 of set of protrusions 204 are aligned much closer together and all engage surface S. The distance (D) from the beginning of a protrusion (protrusion 216 in FIG. 4), which is shown having a flat top 217 for a crown used in each protrusion 210, 212, 214 and 216 in set of protrusions 204, to Corner C1 (FIG. 4) is shown to be in the range of 0.020-0.060 inches. In other words, for the 9/16inch size wrench 200 shown therein, each crown 210, 212, 214 and 216 is also shown to be spaced from each other at a distance in the range of 0.020-0.060 inches. In addition, whereas set of protrusions 104 is located relatively far from corner C1, set of protrusions 204 is relatively close to corner C1. These two characteristics increase the contact of the set of protrusions 204 to surface S of fastener F as compared to the set of protrusions 104, and further increase the closeness or proximity of respective protrusions 210, 212, 214 and 216 to corner C1 as compared to respective protrusions 110, 112, 114 and 116. These factors increase the torque T applied to fastener F of wrench 200 compared to that of wrench 100 or other conventional wrenches known in the art. This has the effect of increasing the turning power of wrench 200 over wrench 100, or other conventional wrenches known in the art, for the application of a given amount of turning force to the respective wrenches, based on the formula T=f×L, where T=torque, f=force and L=distance. In other words, as shown therein, all of the protrusions 204 have been aligned closer to the surface S of the fastener F, and have been moved toward the corner of the fastener head so as to maximize torque.

It should be understood and appreciated that protrusions 204 and 206 are scalable. In other words, for larger wrenches, the radii will be larger and there may be more protrusions, whereas for smaller wrenches the radii will be smaller and there may be fewer protrusions. The number of protrusions can also be dependent on the particular manufacturing method used to fabricate wrench 200. In other words, it should be understood and appreciated that the dimensions provided above are illustrative to the instant embodiment as shown in the figures. However, it should also be understood that an alternative wrench according to the present invention, for example a wrench 50% larger, would have corresponding dimensions that are 50% larger (i.e., would be scalable). Also for example, a wrench such as a ¼ inch wrench (or any other wrench smaller than a ⅜ inch wrench) in accordance with the present invention may have only 3 protrusions in each opposing pair of protrusions due to wrench-size limitations. However, a ⅜ inch wrench (and those larger) may have 4 protrusions, or at least 4 protrusions, in each opposing set of protrusions and which are scalable in accordance with the present invention. In turn, each protrusion of each opposing set of protrusions of a given wrench in accordance with the present invention (regardless of the particular size of the wrench) may be advantageously rotated (or tilted) and configured accordingly to maximize the placement of each protrusion of each opposing set of protrusions of a given innovative wrench relative to the surface of the corresponding fastener and such that each protrusion of each opposing set of protrusions of a given innovative wrench is in contact with the corresponding fastener surface while in a resting state engagement between the innovative wrench and the corresponding fastener. In another embodiment, at least one protrusion is in at least close proximity with the corresponding fastener surface while in a resting state engagement between the innovative wrench and the corresponding fastener. It should be understood that close proximity in this sense is at least 5/1000ths of an inch or less, or in the range of 2/1000ths of an inch-3/1000ths of an inch. In yet another embodiment, a plurality of protrusions are in close proximity with the corresponding fastener surface while in a resting state engagement between the innovative wrench and the corresponding fastener. In yet another embodiment, at least one protrusion is in contact with the corresponding fastener surface while in a resting state engagement between the innovative wrench and the corresponding fastener. In still yet another embodiment, all of the protrusions are in contact with the corresponding fastener surface while in a resting state engagement between the innovative wrench and the corresponding fastener.

For the 9/16" size wrench shown in FIG. 4, inventive wrench 202 has a set of recesses 218 including individual recesses 220, 222, 224 and 226 separating the respective protrusions 210, 212, 214 and 216. Recesses 218 are preferably of equal size and are shown as having radii $R_{REC}$ of 0.010 inches, and a diameter $D_{REC}$ of 0.0180 inches. This is larger than the corresponding radii for recesses 118 shown as having radii $R_{REC}$=0.0085 inches. The radius of inventive wrench 200 equals preferably 0.5273 inches larger than the radius of WRIGHT GRIP® wrench 100 of 0.5016 inches.

Figure 7:
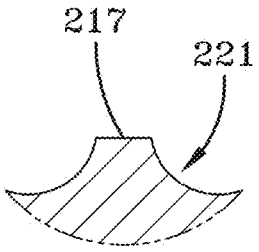
FIGS. 7 and 8 are enlarged details of two types of protrusions for use with embodiments according to the present invention.

In accordance with an embodiment of the present invention, one type of the top of protrusions 214 could be flat as shown in FIG. 4. The plane of the uppermost portions 217 (i.e., crown(s)) of each protrusion 210, 212, 214 and 216 in set of protrusions 204, as illustrated in FIGS. 4 and 7) may be slightly angled downwardly towards Corner C1 when engaged with surface S of fastener F. Crowns 217 of each of the set of protrusions 214 are coplanar, and the angle between the plane including crowns 217 and the plane of surface S of fastener F is at an angle θ, which is preferably greater than that for an equal size WRIGHT GRIP® wrench 100. For the illustrated wrench 200 of the 9/16 inch size, θ is advantageously in the range of 75°-180°, and more particularly in the range of 175°-180° (FIG. 4).

The protrusions are a very important part of the present invention. The protrusions penetrate the fastener which the inventive wrench is turning. Such penetration enhances the gripping of the jaw of the inventive wrench, and enables the turning of fasteners even where the corners of the fastener have been worn down and rounded. The radius noted above has been increased over corresponding WRIGHT GRIP® wrenches to improve the profile or definition of the respective protrusions.

Figure 5:
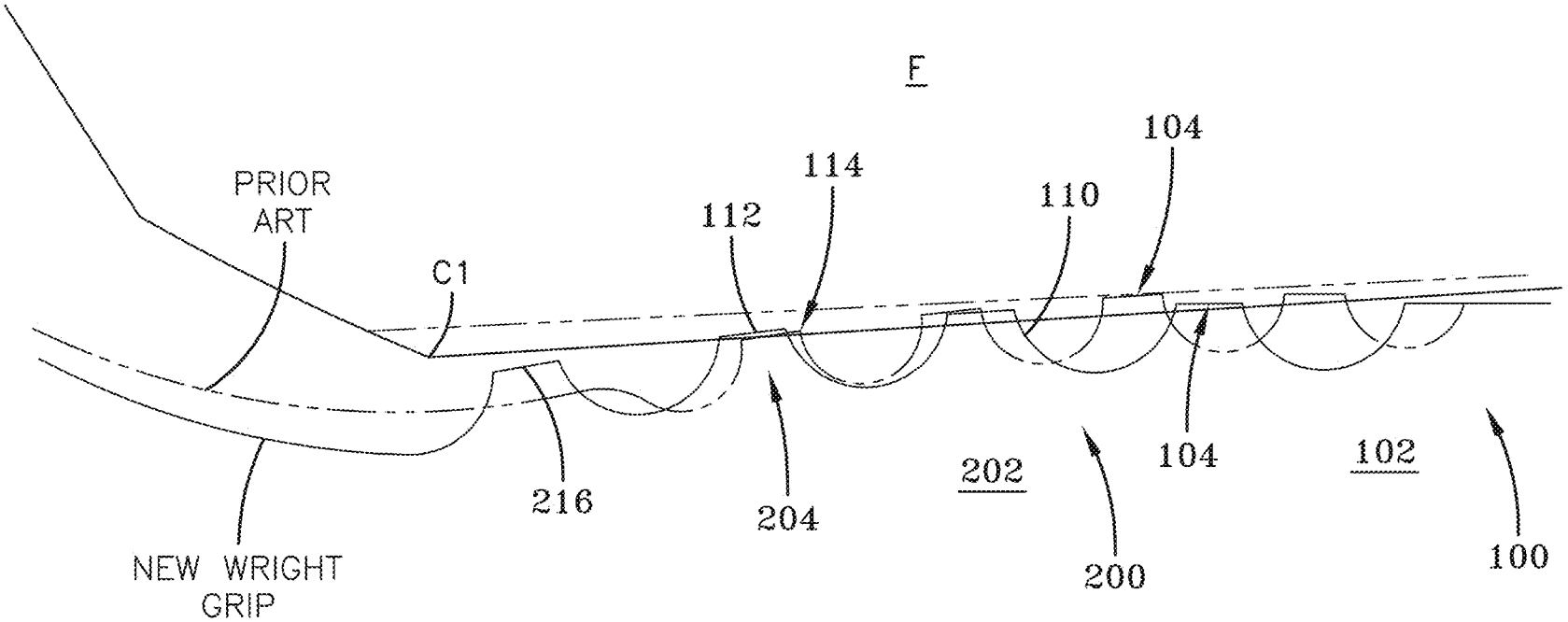
FIGS. 5 and 6 are also enlarged views of the superposition of wrenches with protrusions according to the prior art and wrenches with protrusions according to an embodiment of the present invention for turning a fastener.

FIG. 5 depicts a failed fastener F, and how exactly the protrusions act on the flats of the fastener. Significantly, one protrusion of the present invention closest to the corner C1 that has been rounded does not engage protrusion 216. The three protrusions above (i.e. to the right) of the protrusion 216 that does not engage will still carry the load. In analysing prior art, other than the WRIGHT GRIP®, the protrusions start at the very corner of the fastener, and there are fewer of them than with the WRIGHT GRIP® wrench. Therefore, if the corner of the fastener is destroyed, the one protrusion closest to the corner might not grab or engage the corresponding fastener, and there are only one or two protrusions that may engage with the surface of the fastener, as shown in FIG. 5. Also, fastener F is at an angle relative to the top surfaces of the protrusions. This provides uneven loading and can cause the wrench to slip on the fastener surface more readily.

Reference is still made to FIG. 5 which again shows the superpositions of the prior WRIGHT GRIP® wrench 100 in a partial, detailed illustration in dotted lines and wrench 200 according to an embodiment of the present invention in solid lines. Corner C1 of fastener F has been rounded, and corners C1 have been deformed as a result of extreme force applied to the opposite end of the open end wrench not according to the present invention. WRIGHT GRIP® wrench 100 in the present situation has a protrusion 114 which falls on corner C1 and contributes to the rounding of corner C1. A measurement of a particular fastener F for being turned by a 9/16" size wrench originally had a diameter 0.634 inches, but was rounded to reduce the diameter by 0.026 inches to 0.608 inches. Prior art WRIGHT GRIP® wrench 100 slipped over two corners of fastener F and deformed them until failure, although inventive wrench 200 is nonetheless still able to turn failed fastener F.

Figure 6:
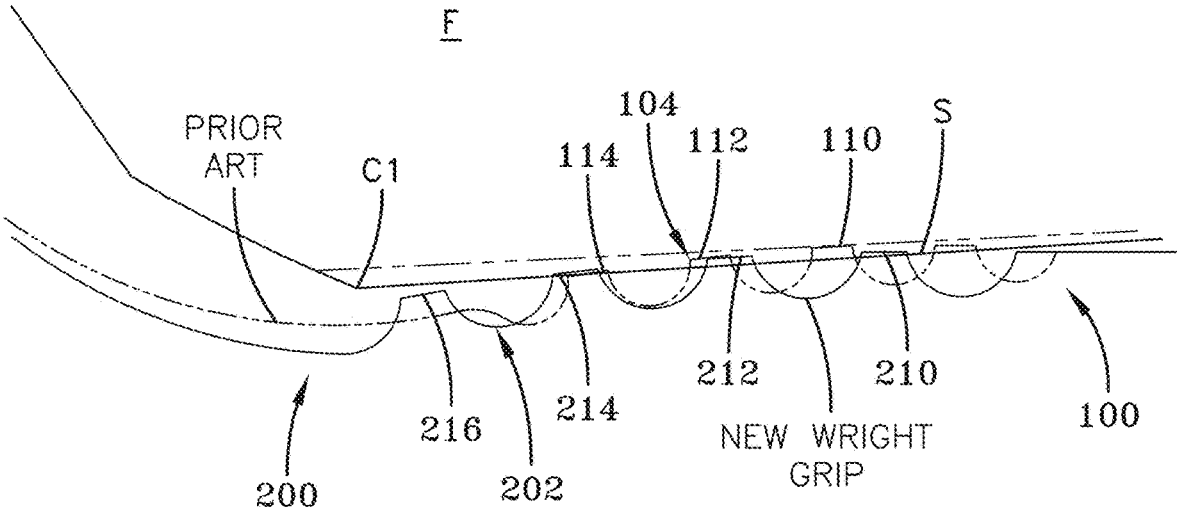

Turning next to FIG. 6, there is again shown a superimposed open end wrench 200 according to the present invention and a prior art, serrated open end wrench 100. Open end wrench 100 has set of protrusions 104 including protrusions 110, 112 and 114. Wrenches 100 and 200 are depicted turning fastener F with corner C1. As illustrated, protrusion 114 closest to the corner C1 of fastener F engages corner C1 of fastener F and does not "grab" corner F. In fact, protrusion 114 engages and imposes a rounding force on corner C1. On the other hand, wrench 200 has protrusion 210, 212, 214 and 216, and each of protrusions 210, 212 and 214 respectively engage side S of fastener F and apply a torque by imposing force on surface S when engaged and turned. Protrusion 216 in this instance does not engage corner C1 at all and does not put a corner-rounding force on corner C1. Protrusions 210, 212 and 214 penetrate surface S to a depth proportional to the force applied to the opposite end of wrench 200. A wrench made according to the foregoing embodiment of the invention will not slip from fastener F even under adverse conditions.

Referring back to FIG. 3, open end wrench 200 has throat 205 for merging jaws 202 and 203 opposite a cavity 207. Wrench 200 has inclined surfaces 217 at the entrance to cavity 207 like surfaces 117 in prior art wrench 100. Open-end wrench 200 has throat 205 which has a uniformly curved surface shown in cross-section by a curve 220. The shape of curve 220 can differ for each size of open-end wrench 200 in a scalable manner as described above. Curve 220 is important because it is at least partly determinative of the timing and area of engagement of the respective individual respective sets of protrusions 204 and 206 depending on the direction of rotation of wrench 200, and the surface of fastener F. According to an aspect of the present invention, curve 220 is at least partly determinative of the location of the area of engagement of each protrusion 210, 212 and 214, and the distance of respective areas of engagement of the respective protrusions 210, 212 and 214, and corner C.

Figure 8:
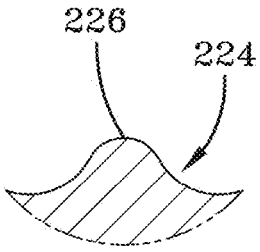

There are numerous variable factors that can affect the engagement of protrusions and the fastener. One variable factor is the configuration of the protrusion. FIG. 7 shows a protrusion 221 having a uniform flat crown 217. The protrusion could alternatively have a rounded top. Referring to FIG. 8, a protrusion 224 is depicted having such a rounded top 226. It should be appreciated and understood that each flat protrusion top 217 is advantageous in that the pressure put on its top 222 is a generally uniform pressure. This would extend the useful life of sets of protrusions 204 and 206, but a possible disadvantage is that the penetration is limited into a fastener to be turned, which could limit the amount of torque to be applied to a fastener F. The rounded top 226 of protrusion 224 would provide point contact (or contact closer to point contact) which would result in deeper penetration of protrusion 224 into fastener F to increase the torque to be applied to fastener F, but a disadvantage would include a more limited useful life of rounded protrusion 224 as compared to sets of protrusions 204 and 206 with crown shapes due to the wearing down of rounded top 226, and the unequal force applied by fastener F to protrusion 224 could possibly impair the life of fastener F and protrusion 224.

Figure 9:
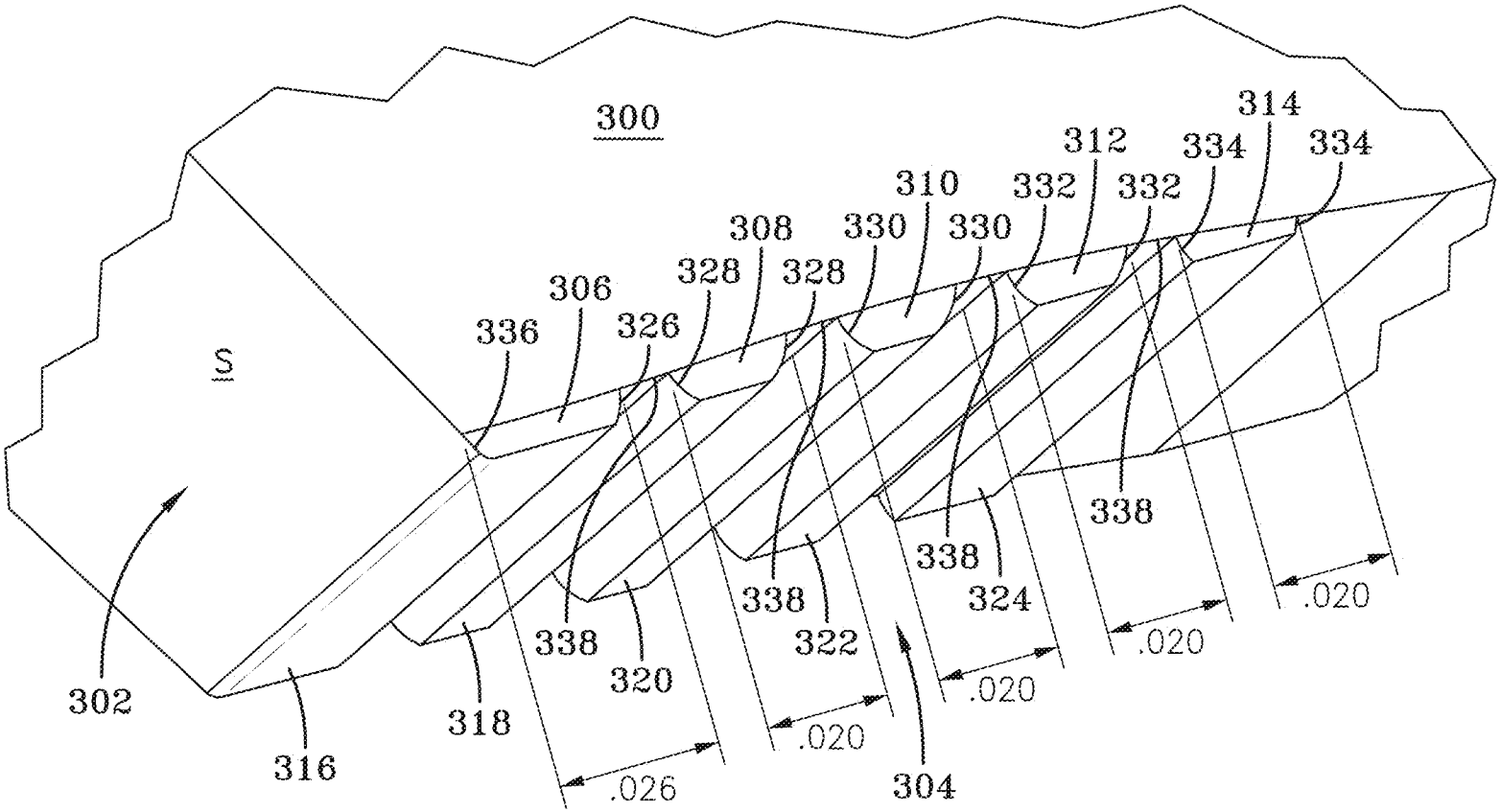
FIG. 9 is an enlarged partial perspective view of a wrench with protrusions according to an embodiment of the present invention.

A shape of protrusions in an alternative embodiment is shown in FIG. 9. FIG. 9 illustrates a portion of a wrench 300 according to an embodiment of the present invention having a jaw 302 with a set of protrusions 304. Set of protrusions 304 includes five protrusions 306, 308, 310, 312 and 314 as shown therein. Protrusion 306 is closest to a surface S of fastener F extending towards a throat T which surface is partly shown in FIG. 9. Each of protrusions 306, 308, 310, 312 and 314 have respective flat crowns 316, 318, 320, 322 and 324. Each of the respective protrusions in set 304 have respective sides 326, 328, 330, 332 and 334 that are curved in cross-section. Protrusion 306 has a curved side 336 adjacent to surface S leading to the throat, and the remaining sides 326, 328, 330, 332 and 334 all extend between the respective recesses 338 between each protrusions in set 304. Protrusion 306 has a width greater than that of protrusions 308, 310, 312 and 314, the latter all being of equal widths. For a 9/16" size wrench according to an embodiment of the invention, the height of each protrusion in set 304 has been advantageously found to be 0.216 inches. Therefore, the total shear area is calculated as follows:

$$4(0.020\ \text{in.}\times 0.216\ \text{in.})+0.026\ \text{in.}\times 0.216\ \text{in.}=0.0229\ \text{in.}^2$$

As indicated above, the technology relating to protrusions, particularly with respect to protrusions on outwardly curved diverging surfaces in open-end wrenches, is important with respect to the present invention. With respect to the present invention, as the wrench turns the fastener (which is often a bolt head or a nut), the head of the fastener becomes lodged in the jaw of the wrench closest to the throat. As the force applied to the handle of the wrench increases, the resultant torque applied by the driving jaw of the wrench on the head of fastener increases in proposition to the applied force. The protrusions on the driving jaw penetrate the side of the fastener, and this penetration prevents the wrench from slipping. As the wrench turns the fastener head, the protrusions penetrate the side of the fastener deeper and there is no failure. The protrusions along with their angular placement on the jaw of the wrench provide a superior open end wrench to any others of which the inventors are aware with an unmatched design.

An aspect of the present invention relates to incorporating features in an open-end wrench according to the invention by increasing the maximum torque to the head of the fastener being turned without failure of the wrench. The following are at least some of the following features: (1) providing relief of force on the throat of the wrench, rearward of the protrusion adjacent to the throat; (2) lengthening the distance between the protrusions on both jaws of the wrench; (3) increasing the width of the concave region between the respective protrusions (i.e. the recesses) to increase the area of the jaw of the wrench that receives and engages the portion of the head of the fastener; and (4) reducing the area of the head of the respective protrusions to approach a point contact with the head of a fastener reduces the force distributions against the fastener to increase the penetration of the respective protrusions into the fastener.

According to a preferred embodiment of the present invention, a set of open-end wrenches is provided having a series of wrenches of different sizes for engaging fasteners of corresponding different sizes for applying maximum torque to the fasteners without rounding, spreading or deforming the respective fastener corners. (The term "fastener" is used herein to cover any item for fastening one piece to another one or more pieces, where the item has a hexagonal or other polygonal cross section, such as (1) a nut including a hexagonal nut, a nylon insert lock, a nylon insert jam lock, a hex nut cap, an acorn incorporating a hex nut, a flange incorporating a hex nut, a square nut and a coupling having a hexagonal cross section, and a thread cutting machine screw with a hexagonal head; (2) a polygonal bolt such as a hex bolt or a flange bolt; and (3) a polygonal washer such as a hex washer or a slotted hex washer.) The inventive open end wrench has a pair of a jaws extending from a throat area which is curved in a concave manner away from the opening of the open-end wrench which has a pair of opposing surfaces that face each other ("facing surfaces") for engaging the fastener. The facing surfaces are generally planar near the open end of the wrench and diverge outwardly away from the central axis of the opened portion between the jaws, and which merge into outwardly diverging curved surfaces, the latter curved surfaces merge into the curved throat portion of the open end wrench. The respective outwardly diverging curved surfaces have a set of protrusions which are designed to engage the side of the hexagonal fastener to which a positive force is to be applied, the flat surface of the opposing fastener-engaging surface of the other jaw applies a reactive force to the fastener. The outwardly diverging curved surface with the protrusions is designed to apply a force to the fastener which applies a maximum torque to the fastener prior to turning of the wrench to enable an easier and improved turning of the fastener upon the application of a turning force to the open-end wrench. The diverging surface with the protrusions is selected so that the protrusions engage the surface of the fastener near, but not on, the corner of the fastener so that each protrusion does not engage and damage the corner of the fastener. Since fasteners come in different sizes, there would be a set of open-end wrenches according to the invention for use with a series of fasteners of different sizes. Therefore, maximum torque is applied to the fasteners regardless of the size of the fastener provided the appropriate open-end wrench according to the invention is selected for use. The term "maximum torque" is being used herein, but this size for applying the maximum torque is within a certain tolerance since the set of open-wrenches according to the invention would not cover every possible size of fastener, but mainly the sizes of fasteners with which the set of inventive wrenches is to be used. Other embodiments of the invention relate to different shapes of the protrusions, different sizes of the protrusions, different locations of the protrusions.

As shown in FIG. 2, the clearance between rear corners C1 and C2 of fastener F, and rearward corners 124 and 126 of wrench 100 are designed to prevent the engagement of, and rounding of, rearward corners C1 and C2. In the event that such an occurrence happens, the torque applied by wrench 100 to fastener F upon the application of a turning force to wrench 100 for a fastener having an effective diameter of 3 13/16 inches, would apply a force vector to the lever arm L of 0.692 inch. While this arrangement would avoid damage to corners C1 and C2 of fastener F, upon the application of a turning force of 1000 pounds, the calculated torque of 1000 LB*0.692 IN.=692 IN*LB OF TORQUE=58 FT*LB OF TORQUE (where * is the multiplication sign). It should be understood that, as shown in FIG. 2, torque is equal to the amount of the force acting on the object multiplied by the distance from its point of application to the axis around which the object rotates.

Figure 1:
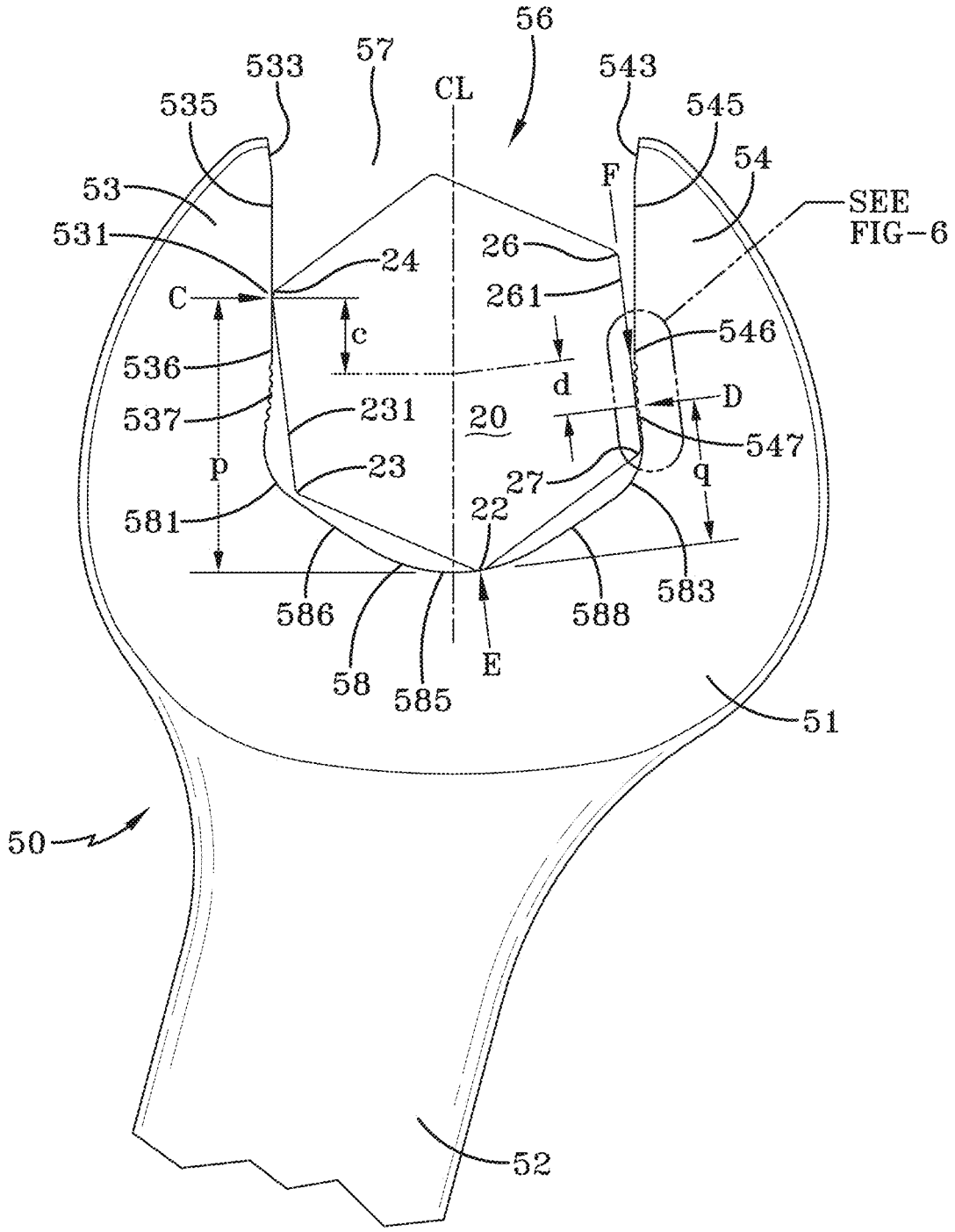
FIG. 1 PRIOR ART
FIG. 1 is a partial plan view of a wrench according to U.S. Pat. No. 6,907,805 (WRIGHT GRIP®) engaging the head of a hexagonal fastener.

Referring next to FIG. 3, the same fastener F is shown having the same dimensions and shown with the same numerical indicators as with FIG. 2. A wrench according to a preferred embodiment of the invention is shown in FIG. 3. As shown in FIG. 3, rather than having an outwardly diverging curved surfaces 119 and 121 extending from the midpoints from the rearwardmost (proximal throat 105) ends of outwardly diverging curved surfaces 119 and 121 to the midpoints of rearward curved corners 124 and 126 by the distances 128 and 130 as shown in FIG. 1, the distances from the midpoints of the rearwardmost ends of outwardly diverging curved surfaces 228 and 230 extend to the midpoints of rearward curved corners 232 and 234 of wrench 200 by the distances 236 and 238, substantially less than dimension 128 and 130 in FIG. 2. The most important distance between FIG. 1 and FIG. 2 is that the lever arm (L2) is 0.982 inch in FIG. 3 as compared to the lever arm (L1) in FIG. 2 of 0.692 inch, indicating a much larger lever arm, and maximum torque for the embodiment of the invention shown in FIG. 3. Thus, upon the application of a turning force of 1000 pounds in FIG. 3, for a torque arm of 982 inch-pounds, the total torque is 82 foot-pounds, as opposed to the torque of 58 foot-pounds for the prior art shown in FIGS. 1 and 2. This is a substantial innovative difference. It should be understood that, as shown in FIG. 2, torque is equal to the amount of the force acting on the object multiplied by the distance from its point of application to the axis around which the object rotates. As shown in FIG. 3, there is shown a 290 in*lb, which represents a 42% improvement with the same force applied. It should be appreciated that the range may be scalable as described above for any particular size and type of wrench according to the present invention.

Referring again to FIG. 4, the angle Θ for a 9/16 inch size wrench showing the angle of outwardly diverging curved section 32' is from 175° to 180°. This amount increases for larger wrenches according to the invention and decreases for smaller wrenches according to the invention.

Figure 10:
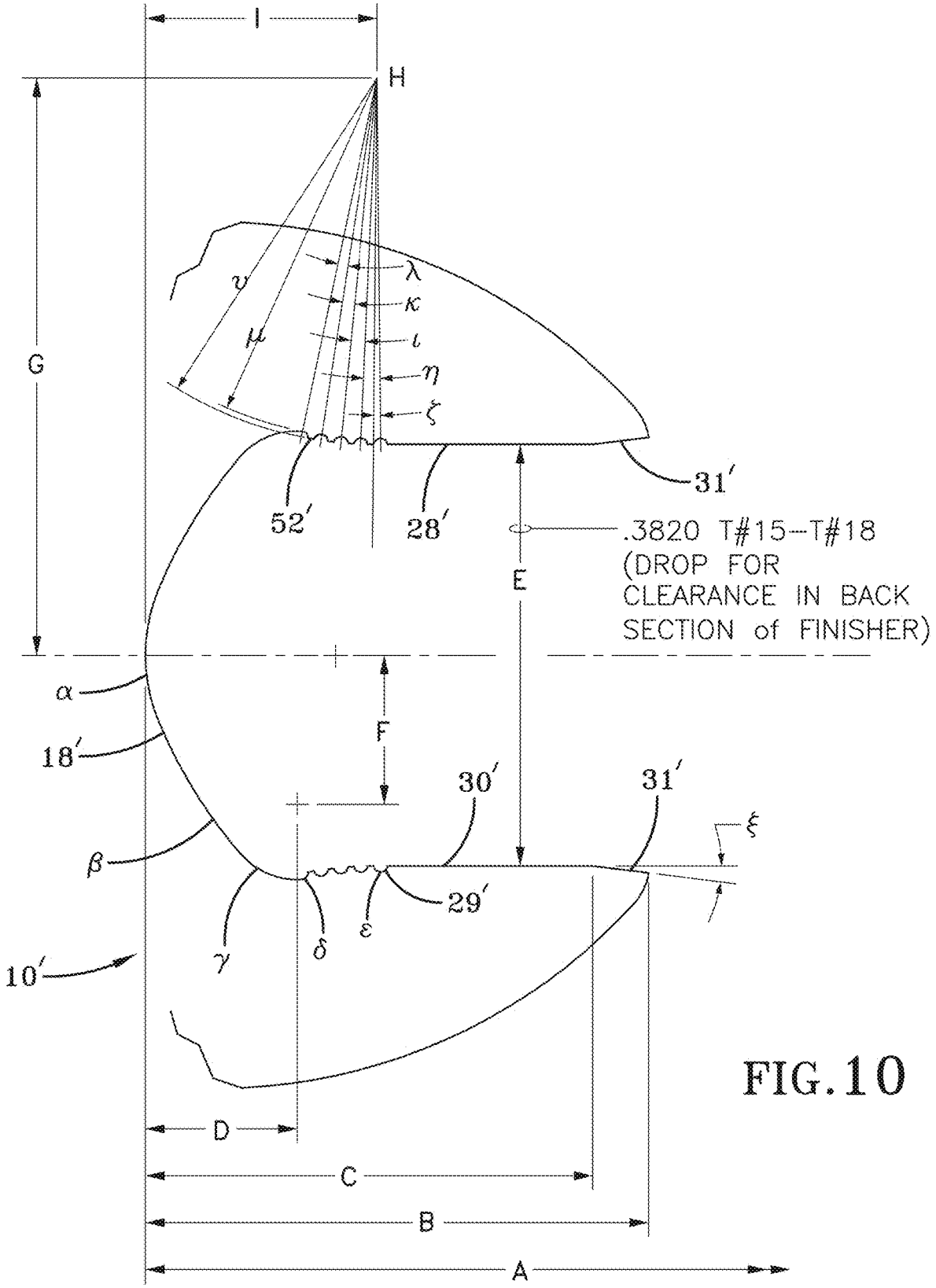
FIG. 10 is a schematic outline of part of a wrench according to an embodiment of the invention.

In order to make a set of open-end wrenches for a series of bolt heads, nuts or other hexagonal fasteners, it is been found that each of the following dimensions are needed for wrenches according to many embodiments of the present invention, as found in FIG. 10:

A=overall depth of wrench from tip of opening to end of the throat

B=depth from tip of opening to endmost part of the throat

C=depth from end of planar section 30' to endmost part 19' of throat 18'

D=depth from inner end of outwardly diverging curved surface to endmost part of the throat E=distance between planar opposing surfaces of the jaws F=distance between the longitudinal center of open-end wrench which intersects with depth D to define the radius for the outer curvature of one of the jaws G=distance between the longitudinal center of open-end wrench 10' and the axis of rotation for the curve of one of the outwardly diverging curved surfaces H=the axis of curvature for the respective protuberances and recesses for one of the jaws I=the distance from the throat to location H α=radius of the throat β=radius of curvature for the portion of the throat on opposite sides of endmost part of the throat γ=radius of curvature between β and the innermost part of outwardly diverging curved surfaces δ=radius of an innermost protrusion ε=radius of an outermost recess ζ=angle of curvature of an outermost portion of outwardly diverging curved surface 36'

η=radius of curvature of the sequentially inner portion of outward diverging curved surface ι=radius of curvature of the next sequentially portion of outwardly diverging curved surface κ=radius of curvature of the next sequentially inner portion of outwardly diverging curved surface λ=radius of curvature of the next sequentially inner portion of outwardly diverging curved surface when such radius of curvature exists μ=radius of curvature of the inner most portion of outwardly diverging curved surface ν=radius of curvature of the rearwardmost radius ξ=angle of slightly-inclined surface at the entrance to the cavity of the wrench As explained below, the protrusion or tooth profile can provide further advantages over the prior art of the present invention. The protrusion profile can be an elongated, tear drop shape. The elongated region is due, not only to the compressive or downward force to make the depression, but also to a large shear stress acting to push the material horizontally. It has been noted that in addition to the visual shape of the depression, the resulting radius is of the same shape as that of the concave portion of the protrusion. When the material reaches the maximum depth of the protrusion, the maximum stressor will be more distributed and will stop deforming further into the head of the fastener. Thus, without further penetration and increased shear stresses on the bolt surface, the material will eventually flow toward the corner of the fastener, and failure may occur there unless the fastener does not fail first.

Figure 11A:
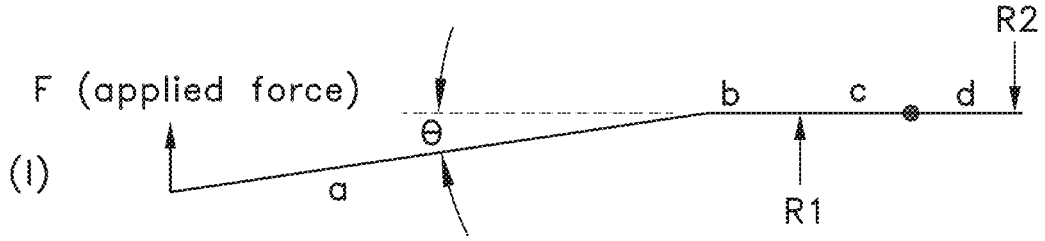
FIG. 11(A) is a Free Body Diagram (FBD) of a 9/16 wrench profile according to the present invention.
Figure 11B:
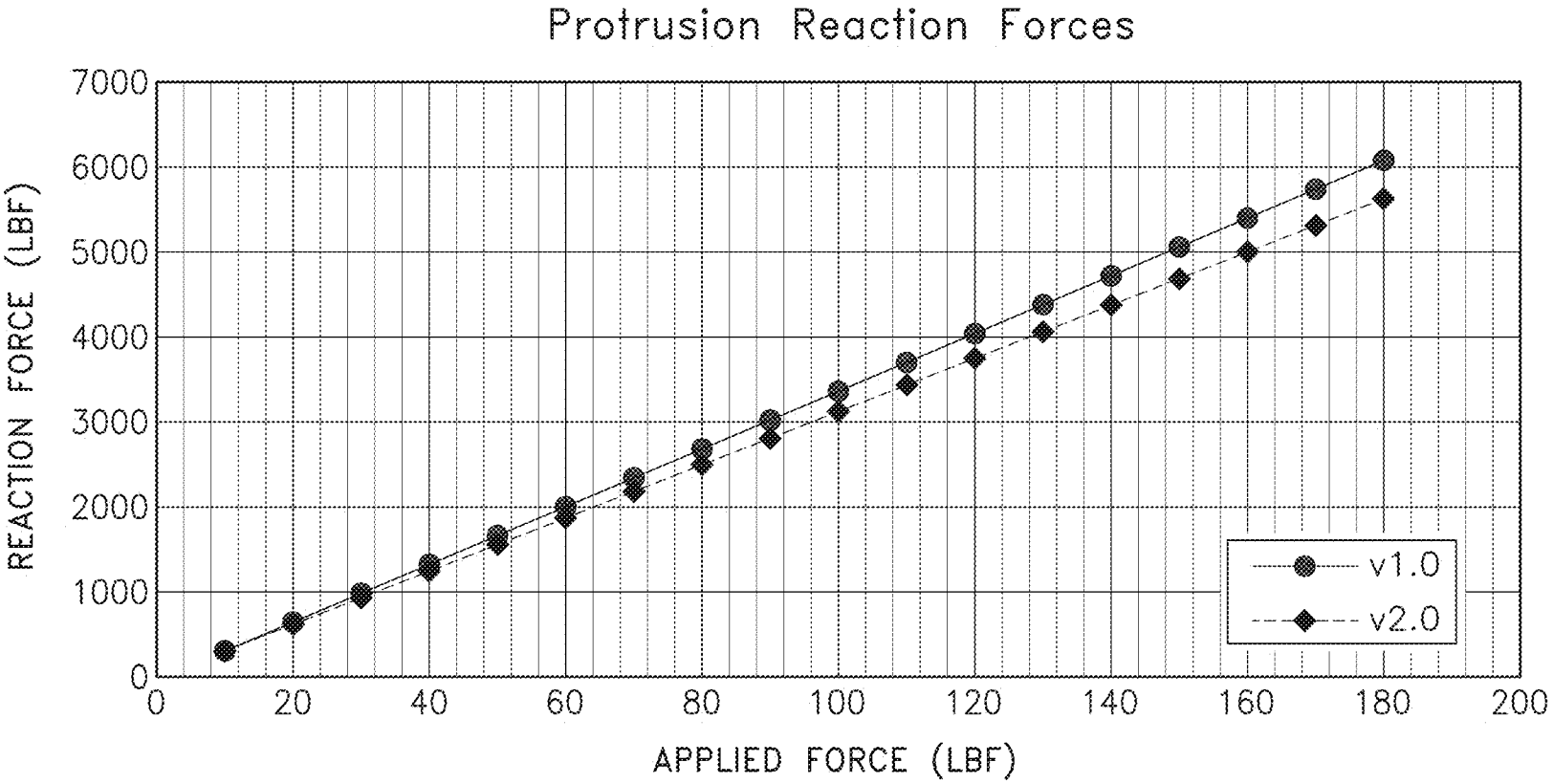
FIG. 11(B) is a graph showing reaction force vs. applied force in accordance with the present invention.
Figure 12B:
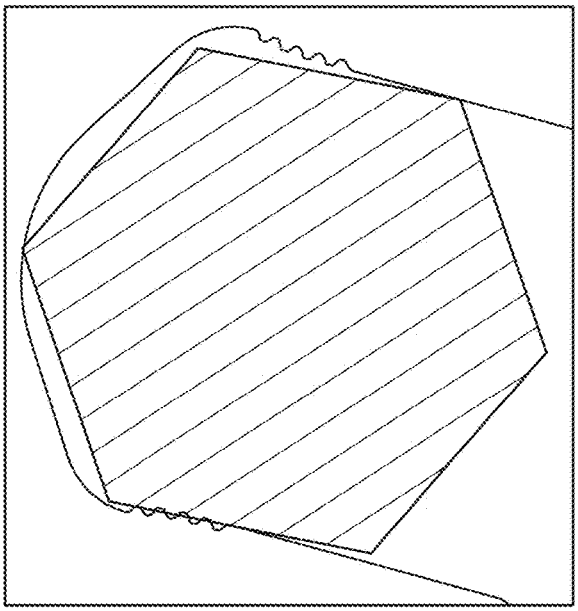
FIG. 12b (PRIOR ART)
FIGS. 12(*a*)-(*f*) depict various protrusion profiles of a wrench according to the present invention.
Figure 12D:
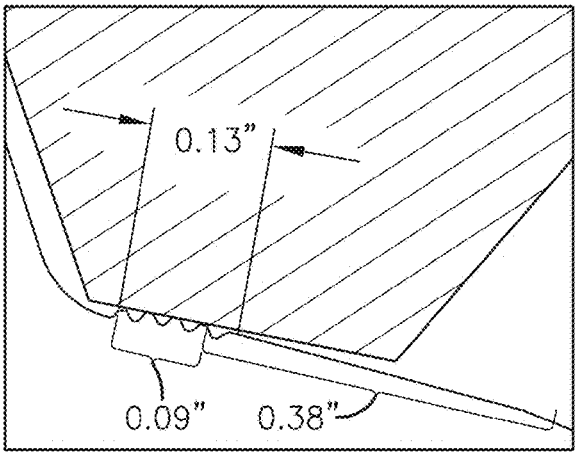
Figure 12E:
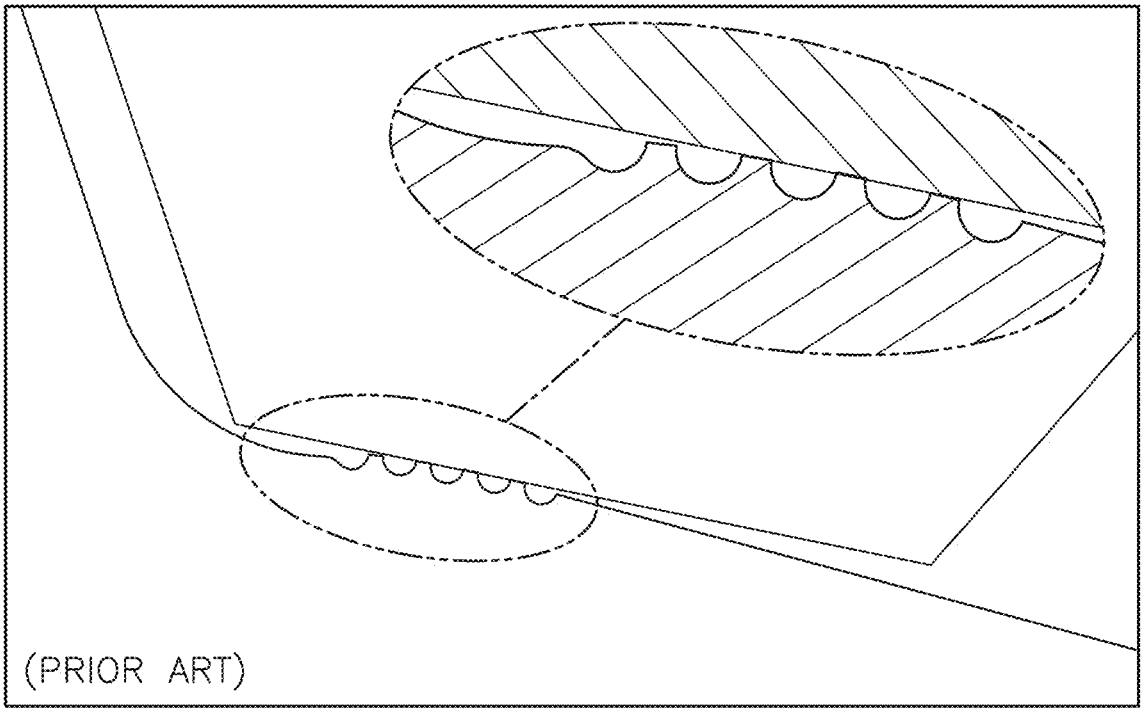
Figure 12F:
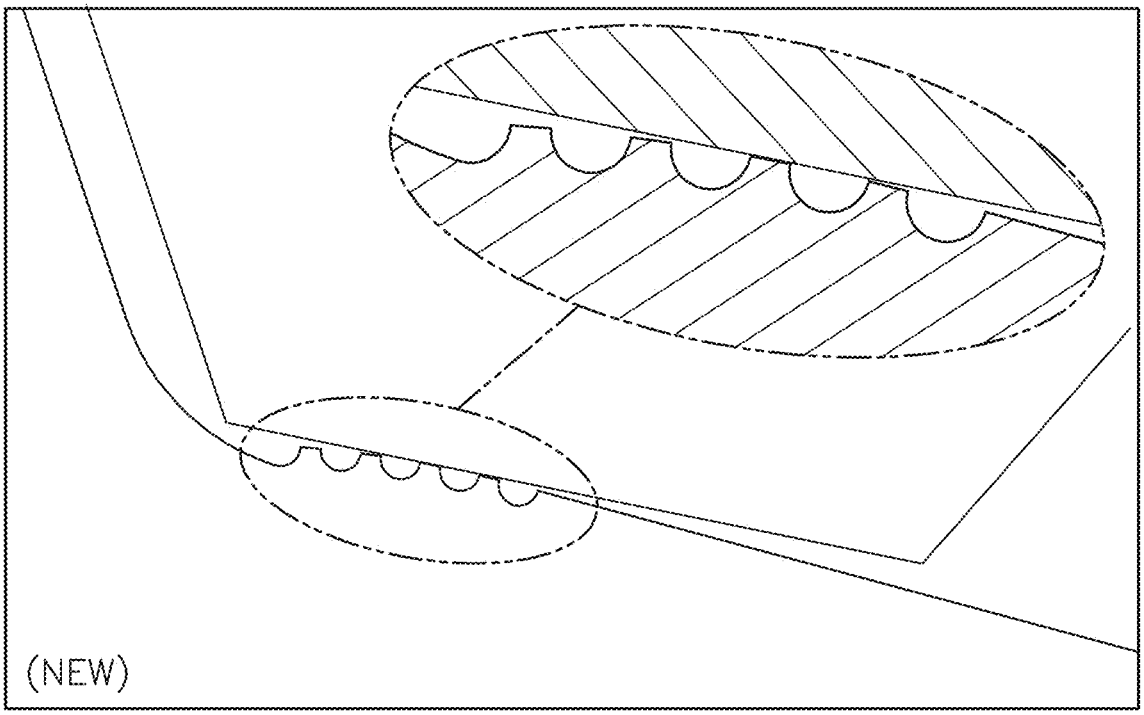

It is also been found as shown in FIGS. 11*a* and 11*b* that a linearly varying geometry allows for increased material depression. The forces on each respective protrusion are different and will penetrate the fastener material at a different rate. Moreover, the protrusion, when touching the fastener material, will produce a uniform pressure over the flat portion of the tooth.

FIG. 12, discussed further below, indicates that where the protrusion has a cylindrical shape or a spherical shape, this type of geometry occurs when the protrusion contacts the surface of the fastener. This configuration generates a point loading configuration. This is different than the distributed pressure profile shown in FIG. 11. The point loading orientation, particularly in contact mechanics, produces an "infinitely" large initial load. This allows immediate surface penetration. Thus, even at light loading, the profile will start to "grab" onto the fastener head and start embedding into the fastener head surface.

In some of the preferred embodiments of the invention, the last protrusion on the inside of the respective jaws is at the commencement of the throat. It proceeds from the top of the innermost protrusion to the rounded rear corner 234 in FIG. 3 to avoid contact of the fastener with the wrench to allow further penetration of the protrusion into the fastener, resulting in protrusions penetrating deeper into the fastener.

The inventive concept involves increasing the maximum amount of torque until failure occurs by providing the following:

a. there is a relief of the wrench throat rearward of the most-rearward protrusion;

b. lengthening the distance between the protrusions;

c. increasing the width of the concave region between the protrusions, to increase the area for receiving the portion of the fastener;

d. providing that the closer the respective protrusions go to point contact reduces the force distribution, i.e. resulting in a decrease in the surface contact of each protrusion;

e. number of protrusions is increased that engage the fastener; and f. the increase in the maximum torque to failure occurs.

The present invention involves an analysis of the changes in the geometry and the determination of the optimal shape of the protrusions used in the present open-end wrenches. This involves a static analysis of the forces acting on the surface of the fastener head as for applying torque to the head. A force body diagram is used to analyse the geometric parameters to the wrench to determine the forces acting thereon.

Bolt testing was done wherein certain assumptions were made about some parameters and certain assumptions were also made about some properties. There were a total of 6 bolts used for 3 different applied loads and for each protrusion geometry. Therefore a total of 36 test bolts were tested to determine depth data. Bolt depths were accomplished using a Mirco-View visual comparator, which allowed for a quantitative depth determination, but a qualitative view of the bolt surface penetration. A visual image of the protrusion insertion into the bolt surface using the optical comparator can be seen in the side figure of FIG. 11B.

To determine the quality of the measured data, a standard deviation of the true mean was performed on the data set to determine the error associated with the test. Figliola, R. S. and Beasley, D. E *Theory and Design for Mechanical Measurements,* 4th Ed. Table 11 below (corresponding to FIG. 11B), presents the protrusion depth comparison for the heavy loaded configuration, where the applied load was 63 lbf. This figure looks at both v1.0 and v2.0 protrusions, which are represented in different symbols, and which were measured by means of an optical comparator. The applied load, only two serration patterns were seen on the bolt surface for v1.0 and a total of three protrusion marks were seen on the bolt head for v2.0. It can be seen that the v2.0 protrusion geometry produces a larger depth compared to the standard v1.0 geometry. Additionally, the inclusion of a third serration allows for more gripping and less slipping due to the bolt's material wing.

Figure 15:
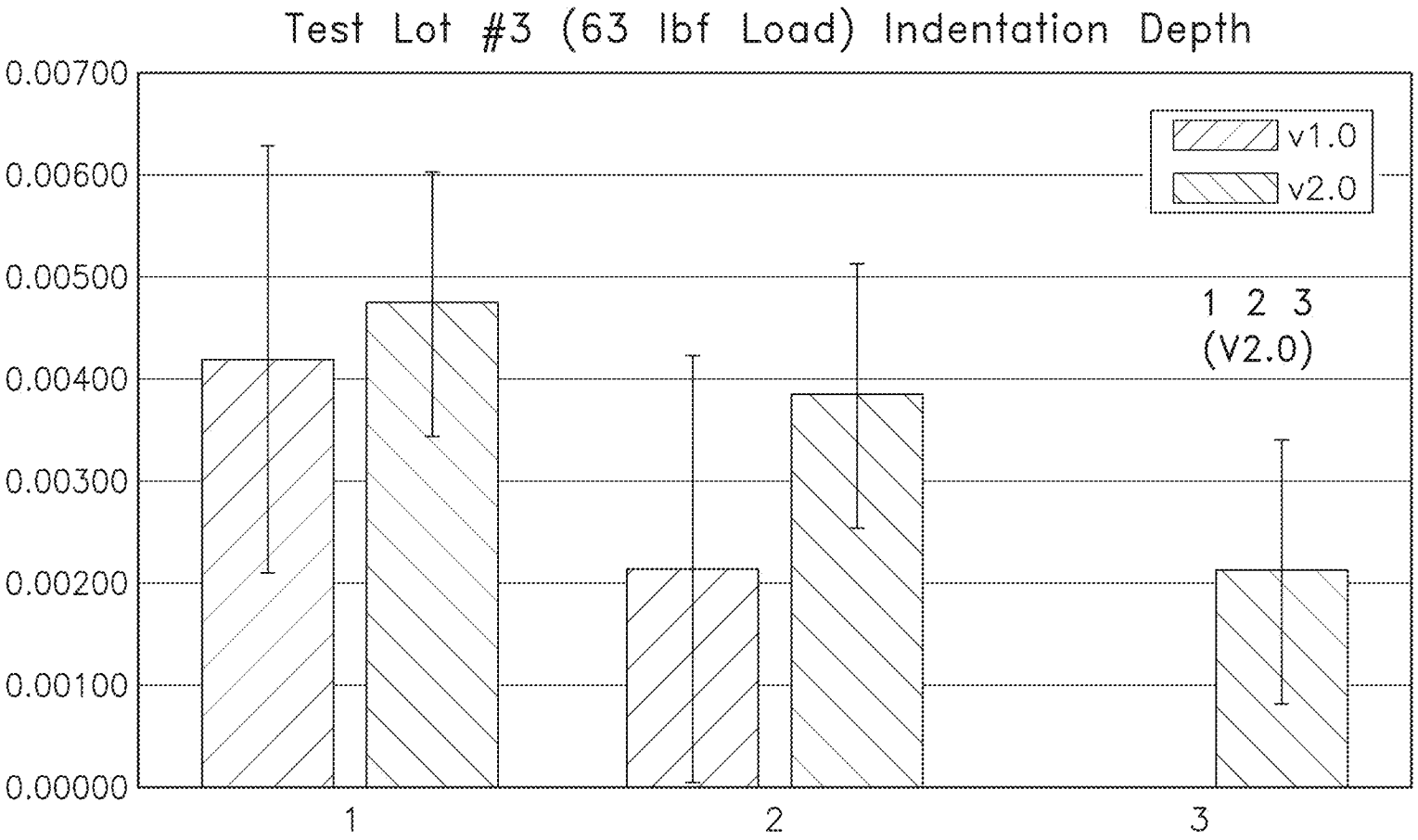
FIG. 15 is a bar graph depicting the overall protrusion indentation profiles for a highly loaded wrench according to the invention.

FIG. 15 presents the overall protrusion indentation profiles for a highly loaded wrench according to the invention. In this particular study, a steady 75 ft-lbf torque was applied to the fastener head for 30 seconds. It should be noted that in this case, both the v1.0 and v2.0 saw maximum penetration into the bolt head. The evidence of this is shown in subfigures 13(*b*) and 13(*e*), where the material has been shaped to a radius. Each identifiable tooth profile has a typical feature, which is an elongated, tear drop shape. The elongated region is not only due to the compressive (downward) force to make the depression, but a large shear stress acting to push the material horizontally. In addition to the visual shape of the depression, the resulting radius at positions 2 and 3 (see FIGS. 13(*a*) and 13(*c*)) are the same shape as that of the concave portion of the protrusion. It should be noted that when the material reaches the maximum depth of the protrusion, that the maximum stresses will be more distributed and will stop deforming further into the bolt head. Therefore, without further penetration and increased shear stresses on the bolt surface, the material will eventually flow towards the corner of the bolt and that is where failure will occur, if the bolt does not first fail.

The formula as shown and depicted in (FIG. 11 (A) is the force diagram for a 9/16" size opening wrench.

The geometric formula as also shown and depicted in FIG. 11 (A) determines the value of $R_2$.

$$R_2 = F_n \frac{\frac{c + b + a\cos\theta}{c} - 1}{\frac{d}{c} + 1}$$

$$R_2 = F_n + R_2$$

The present study compares the prior protrusion profile (v1.0) of the WRIGHT GRIP® wrench against the protrusion profile v2.0 of the present invention. Various force loads were applied into the free body diagram geometries for both profiles v1.0 and v2.0 to determine the reaction force $R_2$. The reaction forces vary in a linear fashion with respect to the applied load as shown in the graph shown and depicted in FIG. 11(B).

As shown in FIG. 11(A), the Free Body Diagram (FBD) of the 9/16 wrench profile and (B) Reaction forces the "group" of protrusions will act on the bolt surface for an applied force (f) acting on the wrench handle.

The reaction force $R_2$ is used to determine the pressure each protrusion will place on the surface of the head of the fastener.

The experimental work proceeded as follows. The test was made on a 4140 steel housing that was machined to prepare a hole in test bolt. The test bolt could be threaded into the prepared fixture. The front surface of the bolt was machined. The machined hole was drilled and tapped perpendicular to the machined front surface so that the wrench could set flush against the steel fixture. The wrench used was a 9/16" open-end wrench. A load was applied to the 9/16" open-end wrench was done with a set of calibrated weights that were fixed to the end of the wrench by a fixture. This was a "dead-hang" set up that allowed for an accurate, constant load applied as the load during each test. An angle meter was affixed to the shaft of the wrench to assure proper and accurate loading during each test. The associated "normal" applied load force $F_n$ was determined for each set of hung weights.

Reference is made to the depiction shown in FIGS. 12(*a*)-12(*e*), wherein 12(*a*) depicts a v1.0 protrusion profile, 12(*b*) depicts a v2.0 protrusion profile, 12(*c*) depicts v1.0 overall length and protrusion length and location with respect to the top of the driving jaw, and 12(*d*) depicts the overall length and protrusion length and location with respect to the top of the driving draw.

A depiction is also shown and provided in FIG. 12(*e*) of protrusions following tightening of a fastener using a wrench according to the present invention where protrusions are in proper form, and in 12(*f*) where the protrusions closest to the throat of the wrench are somewhat worn down.

Figure 13:
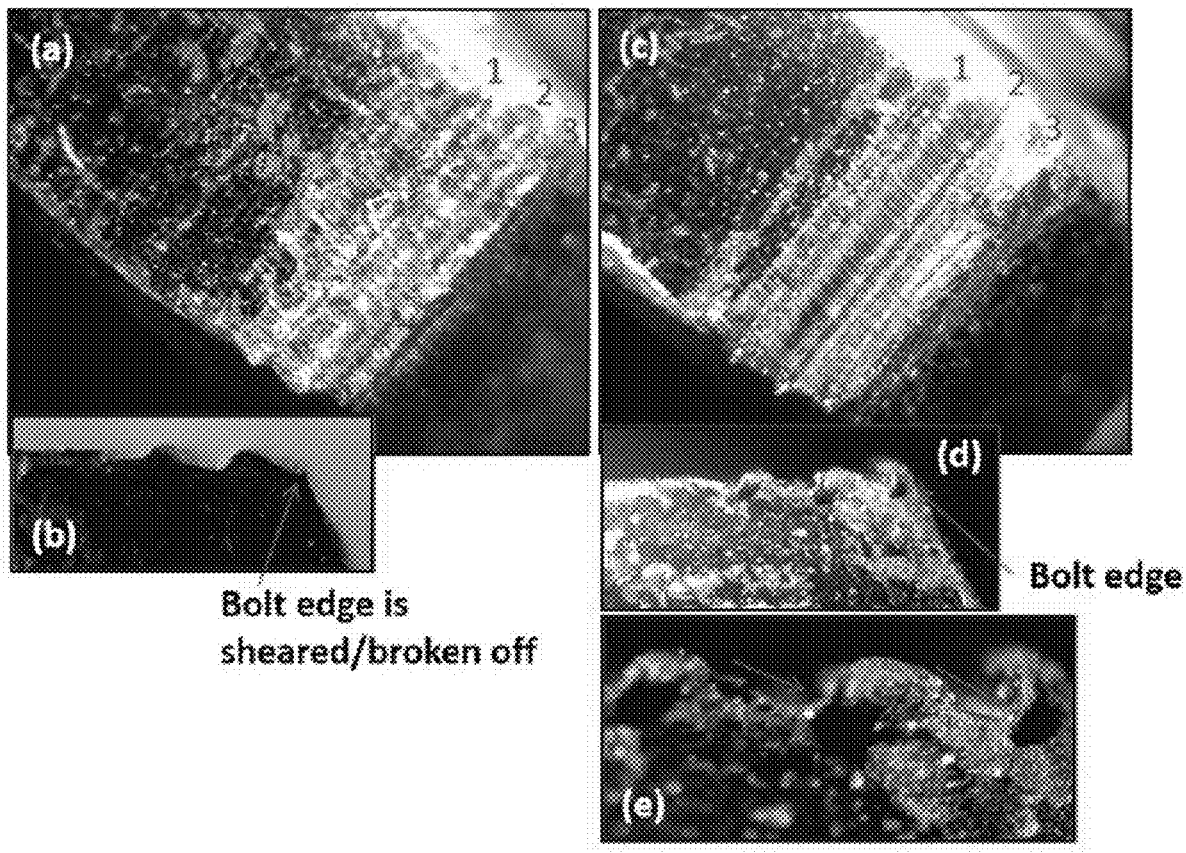
FIG. 13 (views (a)-(e)) depicts photographs of test samples of a wrench with various protrusions.

FIG. 13 having views (a)-(e) is composed of photographs of test samples of the v1.0 and v2.0 protrusion penetration depths for the 75 foot×pound force loading. FIG. 13(*a*) is an isometric view of the v1.0 protrusion marks left on Grade 8 bolt head, FIG. 13(*b*) is a side depth profile of the v1.0 protrusion provide, FIG. 13(*c*) is an isometric view of the v2.0 protrusion marks left on the Grade 8 fastener head, FIG. 13(*d*) is the side depth profile and FIG. 13(*c*) is the magnification of the protrusion/fastener head interface of the v1.0 profile.

From the concluding tests discussed above and resulting protrusion trace photographs, there are improved and innovative geometries shown. These geometries, shown in FIGS. 14(*a*) and 14(*c*) respectively show a linearly varying protrusion pattern 400 (FIG. 14*a*) and a spherical type protrusion geometry 500 (FIG. 14*c*). The linearly varying geometry, FIG. 14(*a*), allows for increased material depression since, in reality the forces on each respective tooth is different and each will penetrate the bolt material at a different rate. Additionally, the protrusion "tooth" 410 when touching the bolt material (412), will produce a uniform pressure over the flat of the tooth.

Another type of profile, as shown in FIG. 14(*c*), uses a cylindrical shape/spherical shape protrusion 510. The benefit of this type of geometry occurs when the protrusion contacts the surface of the bolt 512. This configuration will generate a point loading configuration. This is quite different than the distributed pressure profile presented in FIG. 14(*a*). The point loading orientation, especially in contact mechanics, will produce an "infinitively" large initial load, thus allowing for immediate surface penetration. Therefore, even at light loading, the profile will start to "grab" onto the bolt head and start embedding into the bolt head surface in accordance with the present invention.

An analysis of existing protrusion geometries has been performed. This analysis henceforth allows for baseline comparison to be performed against other proposed geometries and/or enhancements. A linearly decreasing protrusion profile and/or a cylindrical shaped protrusion are part of the inventive concept. The linearly decreasing protrusion allows the first protrusion to have a deeper cavity initially while the other cavities progressively get shallower. This allows for deeper penetration of the protrusion profiles. The second protrusion will exploit the point force and/or line load solution to allow for much deeper initial penetration especially in lightly loaded wrenches.

In performing the executed test described above, it was found that the wrench setup in accordance with the present invention is not only simple, but more accurate as a result of the Nth order uncertainty analysis. As shown in FIG. 15, there is a bar graph depicting the overall protrusion indentation profiles for a highly loaded wrench according to the invention.

Figure 16:
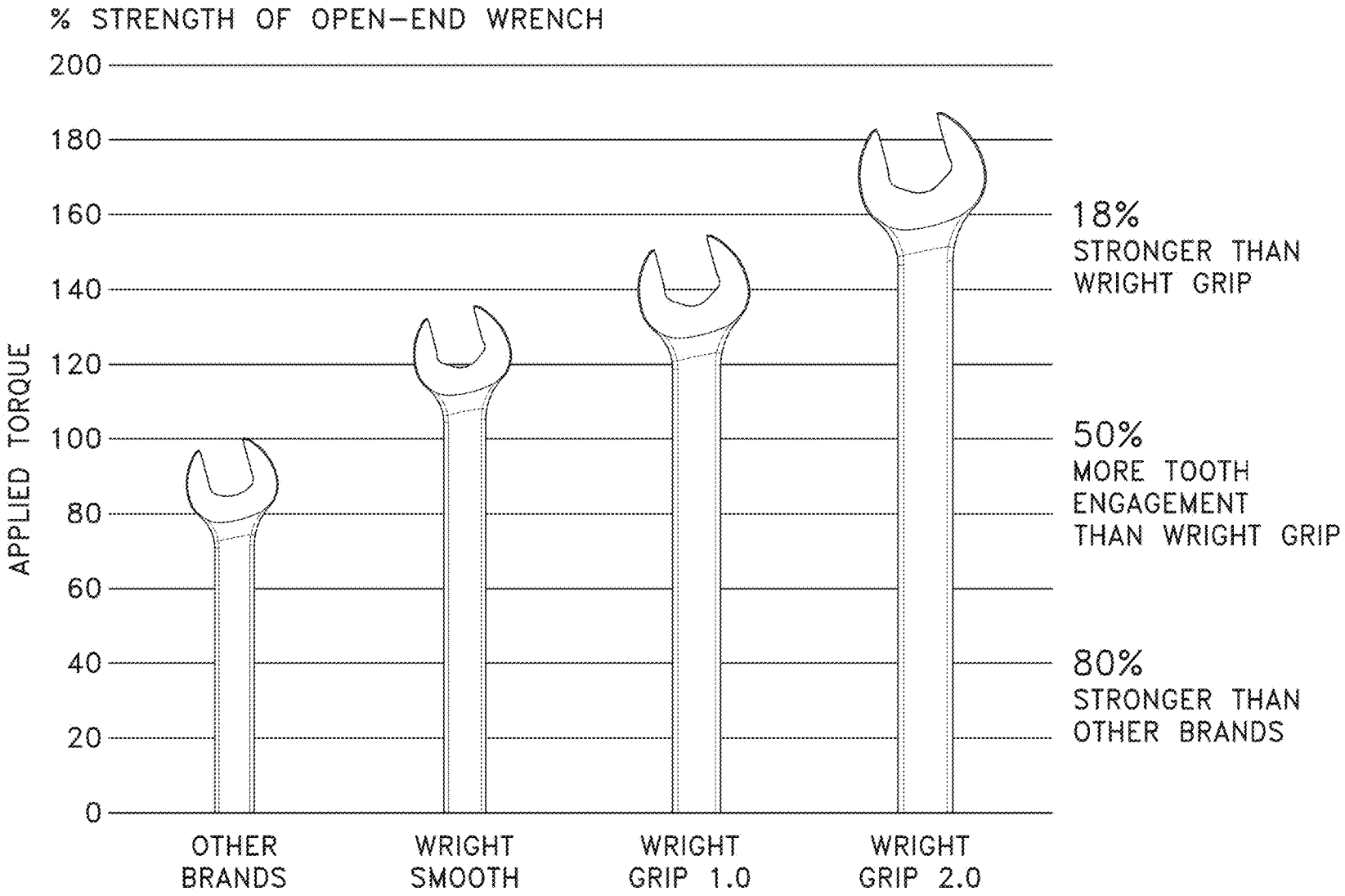
FIGS. 16 and 17 are illustrations of a wrench according to a preferred embodiment of the invention.
Figure 17:
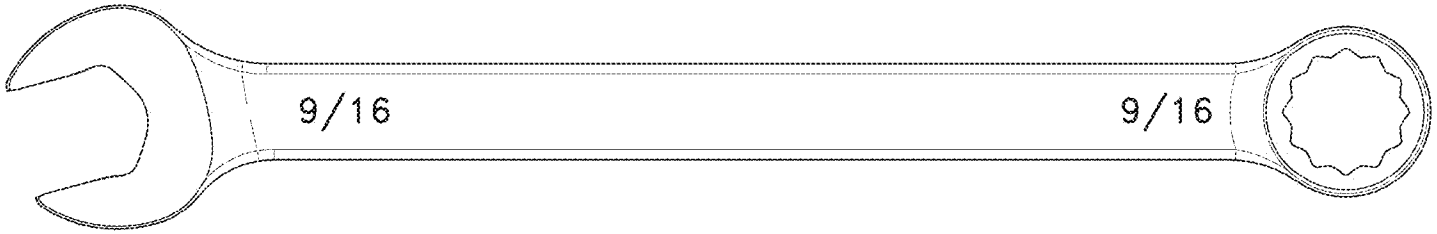

A version of the inventive wrench is disclosed in FIGS. 16 and 17. FIG. 16 is a picture of the inventive wrench described as "Wright Grip 2.0," and two other wrenches made by the Wright Tool Company and a third wrench made by other companies. It can be seen from the bar graph that the inventive wrench has more than 50% of tooth engagement than the previous WRIGHT GRIP® wrench, and 80% more tooth engagement than any other open end wrench made by other companies. FIG. 17 is another view of the inventive wrench for the 9/16" size. These are indeed remarkable wrenches, providing more strength, higher gripping power and able to turn fasteners whose corners have been rounded down and unable to be turned by prior wrenches known in the art.

Figure 18:
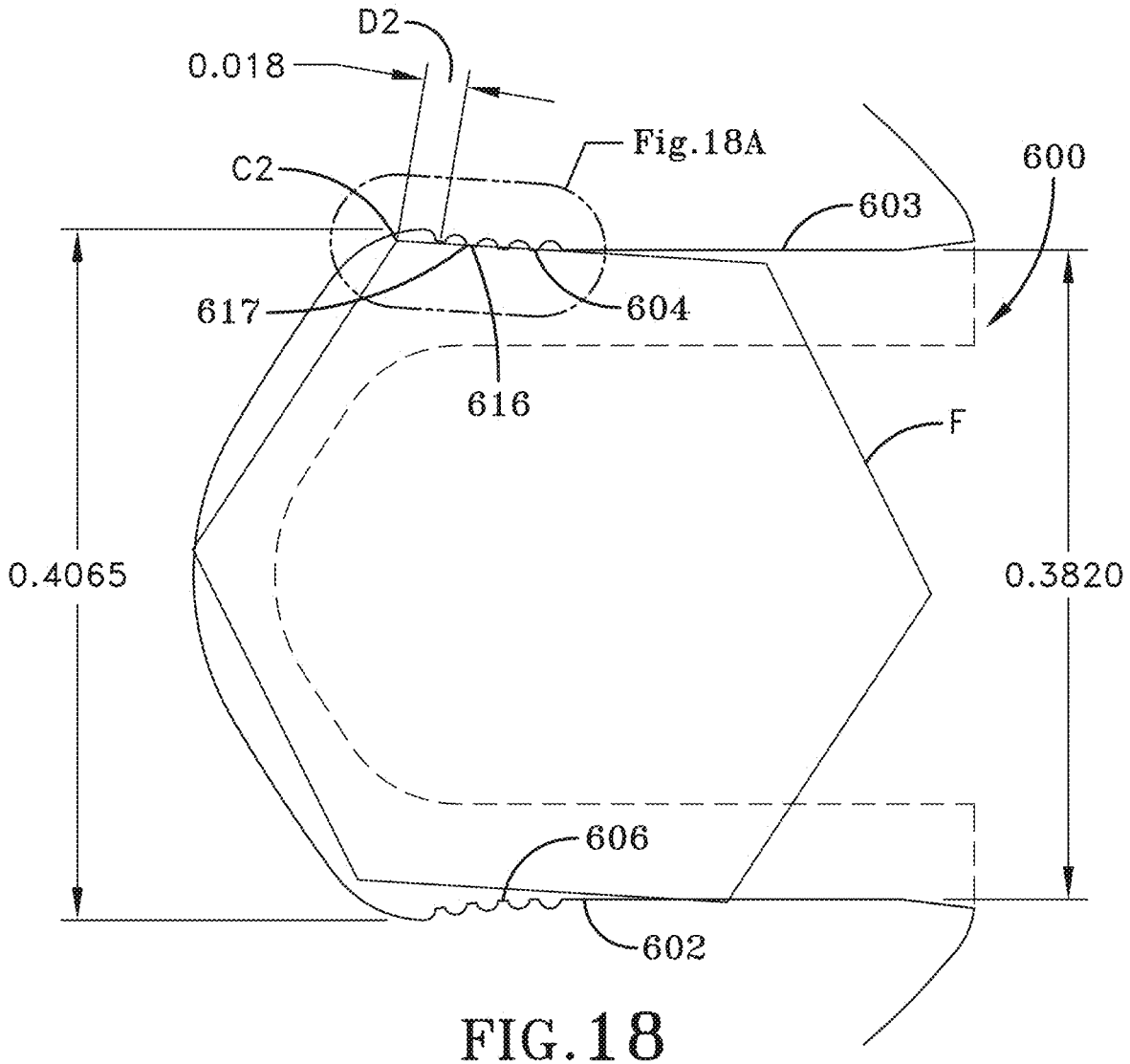
FIGS. 18 and 18A are partial plan enlarged, detail views of an alternative embodiment of a wrench according to the present invention, with FIG. 18A being an exploded view of a portion of FIG. 18.
Figure 18A:
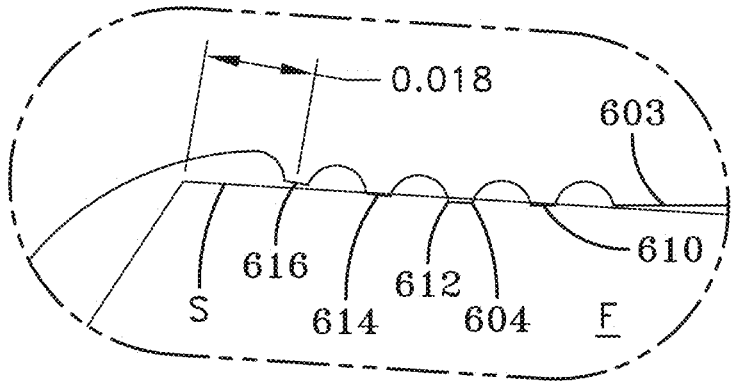

Turning now to FIGS. 18 and 18A, an enlarged and exploded, respectively, representation of a portion of an open-end wrench 600 according to a preferred embodiment of the invention is shown and described. As explained above, wrench 600 has protrusions on one of the working surfaces that would turn to tighten the depicted right hand hexagonal fastener F. Exemplified wrench 600 has a pair of oppositely disposed equally dimensioned, opposite jaws 602, 603. Wrench 600 could be, for example in this instance, a 3/8 inch size open-end wrench. Fastener F has six corners as was explained previously with respect to FIG. 1. Wrench 600 has a pair of opposite sets of protrusions 604 and 606. Fastener F is a right hand fastener as mentioned, and is tightened by turning it in the clockwise direction. When wrench 600 is tightening fastener F, protrusions 606 are the driving protrusions in the same manner as described above.

Still referring to FIGS. 18 and 18A, set of protrusions 604, for example, includes protrusions 610, 612, 614 and 616 which all simultaneously engage a surface S of fastener F while in a resting engagement between fastener F and wrench 600. Moreover, protrusions 610, 612, 614 and 616 of set of protrusions 604 are aligned much closer together and all engage surface S. The distance (D2) from the beginning of a protrusion (protrusion 616 in FIG. 18 4), which is shown having a flat top 617 for a crown used in each protrusion 610, 612, 614 and 616 in set of protrusions 604, to Corner C2 (FIG. 18) is shown to be about 0.018 inches. In other words, for the ⅜ inch size wrench 600 shown therein, each crown 610, 612, 614 and 616 is also shown to be spaced from each other at a distance in the range of about 0.018 inches. In the same manner as above, set of protrusions 604 is relatively close to corner C2. These two characteristics increase the contact of the set of protrusions 604 to surface S of fastener F as compared to the conventional configurations, and further increase the closeness or proximity of respective protrusions 610, 612, 614 and 616 to corner C2. These factors also increase the torque T applied to fastener F of wrench 600 compared to other conventional wrenches known in the art. This has the effect of increasing the turning power of wrench 600 other conventional wrenches known in the art, for the application of a given amount of turning force to the respective wrenches, as also explained above. In other words, as shown therein, all of the protrusions 604 have been aligned closer to the surface S of the fastener F, and have been moved toward the corner of the fastener head so as to maximize torque.

The invention has been described in detail with particular emphasis on the preferred embodiments thereof, but variations and modifications may occur to those skilled in the art from the preceding discussion and from the following claims.

The invention claimed is:

1. A set of open end wrenches of different sizes for turning different sizes of hexagonal fasteners, each of said open end wrenches comprising a pair of opposing sides and a closed end opposite said open end, said open end wrench further comprising:

a throat forming the closed end;

curved rear corners joining said throat to each of said respective opposing sides; and a pair of jaws with opposing fastener engaging surfaces extending from said respective curved corners forming an opening and an open end, said pair of jaws forming said opposing sides and including fastener engaging surfaces for gripping opposing sides of the hexagonal fastener disposed in said opening;

said fastener engaging surfaces each comprising:

a planar surface parallel and opposite said planar surface on the other of said fastener engaging surface and proximal said open end;

diverging curved sections extending outwardly from said planar section, extending from a rear end of said planar surface towards said throat for engaging rear portions of the gripped sides of the hexagonal fastener when said open end wrench turns about an axis of the hexagonal fastener; and a set of protrusions on said respective diverging curved sections for engaging a hexagonal fastener disposed in said opening, said set of protrusions including a protrusion proximal said throat and at least protrusions distal said throat, wherein said at least two protrusions distal said throat are separated from an adjacent protrusion by a recess; and wherein said protrusion proximal said throat is greater in length than the others of said protrusions.

2. The set of open end wrenches according to claim 1, wherein each of said recesses has a common radius for each size of said open end wrench, and the size of said radius increases or decreases with the changing size of said open end wrench in a scalable manner.

3. The set of open end wrenches according to claim 1, wherein each of said diverging curved sections has a common external radius to the top of said protrusions, and said external radius to the top of said protrusions increases or decreases with the changing size of said open end wrench in a scalable manner.

4. The set of open end wrenches according to claim 1, wherein each of said diverging curved sections has a common external radius to the base of said recesses for each size of said open end wrench, wherein the size of said common radius to the base of said recesses increases or decreases with changes in the size of said open end wrench in a scalable manner.

5. The set of open end wrenches according to claim 1, wherein said set of protrusions includes an outer protrusion proximal said open end of said open end wrench, and wherein the radius of the height of said outer protrusion to the commencement of the recess between said outer protrusion and the adjacent protrusion is less than the radii between the heights of the adjacent remaining protrusions.

6. The set of open end wrenches according to claim 1, wherein said protrusions are each defined by an arc of a circle, and wherein the radius of the arc of said protrusions increases or decreases with changing sizes of said open end wrench in a scalable manner.

7. The set of open end wrenches according to claim 1, wherein said throat has a circular curve at the central part of said throat, wherein the radius of said circular curve increases or decreases with the changing size of said open end wrench in a scalable manner.

8. The set of open end wrenches according to claim 1, wherein at least one protrusion of said protrusions is at least in close proximity to a corresponding surface of the hexagonal fastener while in a resting engagement state, wherein close proximity is 5/1000ths of an inch or less.

9. The set of open end wrenches according to claim 8, wherein at least one protrusion of said protrusions is at least in close proximity to a corresponding surface of the hexagonal fastener while in a resting engagement state, wherein close proximity is in the range of between 2/1000ths of an inch-3/1000ths of an inch.

10. The set of open end wrenches according to claim 1, wherein at least one protrusion of said protrusions is in contact with a surface of the hexagonal fastener while in a resting engagement state.

11. The set of open end wrenches according to claim 10, wherein all of said protrusions are in contact with a surface of the hexagonal fastener while in a resting engagement state.

12. A set of open end wrenches according to claim 1 wherein each protrusion of said set of protrusions comprises:

a protrusion base at one of said curved sections; and a protrusion body extending from said protrusion base in a direction away from said base, said protrusion body being inclined toward a corner of a hexagonal fastener closest to said throat of said open end wrench when the hexagonal fastener is disposed between said opposing sides of said wrench with a corner of said hexagonal fastener being engaged with said throat, for enhancing the grip of said curved section on said fastener.

13. A set of open end wrenches according to claim 12 wherein said set of protrusions does not exceed four protrusions, and each of said set of protrusions is in engagement with the side of said hexagonal fastener and is located at a position distal the corner of the hexagonal fastener closest to said throat on the opposite side of the fastener corner from said throat.

14. A set of open end wrenches according to claim 13 wherein the wrench is a ⅜ inch wrench, and said set of protrusions does not exceed three in number.

15. A set of open end wrenches according to claim 13 wherein the wrench is greater than a ⅜ inch wrench, and said set of protrusions is four in number.

16. An open end wrench for turning a hexagonal fastener, said open end wrench comprising a pair of opposing sides and a closed end opposite said open end, said open end wrench further comprising:

a throat forming the closed end;

curved rear corners joining said throat to each of said respective opposing sides; and a pair of jaws with opposing fastener engaging surfaces extending from said respective curved corners forming an opening and an open end, said pair of jaws forming said opposing sides and including fastener engaging surfaces for gripping opposing sides of the hexagonal fastener disposed in said opening;

said fastener engaging surfaces each comprising:

a planar surface parallel and opposite said planar surface on the other of said fastener engaging surface and proximal said open end;

diverging curved sections extending outwardly from said planar section, extending from a rear end of said planar surface towards said throat for engaging rear portions of the gripped sides of the hexagonal fastener when said open end wrench turns about an axis of the hexagonal fastener; and a set of protrusions on said respective diverging curved sections for engaging a hexagonal fastener disposed in said opening, said set of protrusions including a protrusion proximal said throat and at least protrusions distal said throat, wherein said at least two protrusions distal said throat are separated from an adjacent protrusion by a recess; and wherein said protrusions proximal said throat is located by a distance from a fastener located in said opening of said open end wrench to prevent said protrusion proximal said throat from engaging the corner of the fastener in said opening.

17. The open end wrench according to claim 16, wherein said protrusions comprise a fastener engaging area, and at least a portion of said fastener engaging area is flat.

18. The open end wrench according to claim 16, wherein said protrusions comprise a fastener engaging area, and at least part of said portion of said fastener comprises a spherical segment.

19. The open end wrench according to claim 16, wherein said protrusions comprises a truncated cylinder for facilitating the penetration of said protrusions into a hexagonal fastener being turned by said open end wrench.

20. The open end wrench according to claim 16, wherein all of said protrusions engage a fastener being turned by said open end wrench.

21. The open end wrench according to claim 16, wherein a plurality of said protrusions are in contact with a surface of the hexagonal fastener while in a resting engagement state.

22. The open end wrench according to claim 21, wherein all of said protrusions are in contact with a surface of the hexagonal fastener while in a resting engagement state.

* * * * *